US008168362B2

(12) United States Patent
Mera et al.

(10) Patent No.: US 8,168,362 B2
(45) Date of Patent: May 1, 2012

(54) ELECTROSTATIC IMAGE DEVELOPING TONER, METHOD FOR PRODUCING SAME, ELECTROSTATIC IMAGE DEVELOPER, IMAGE FORMING METHOD AND IMAGE FORMING APPARATUS

(75) Inventors: Fumiaki Mera, Kanagawa (JP); Hirotaka Matsuoka, Kanagawa (JP); Yasuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1250 days.

(21) Appl. No.: 11/905,290

(22) Filed: Sep. 28, 2007

(65) Prior Publication Data

US 2008/0199798 A1 Aug. 21, 2008

(30) Foreign Application Priority Data

Feb. 21, 2007 (JP) ..... 2007-041379

(51) Int. Cl.
*G03G 9/087* (2006.01)

(52) U.S. Cl. ..... 430/109.4; 430/123.54; 430/137.14

(58) Field of Classification Search ..... 430/109.4, 430/137.14, 123.5, 123.54; 399/252
See application file for complete search history.

(56) References Cited

U.S. PATENT DOCUMENTS

2005/0026063 A1* 2/2005 Komoto et al. ..... 430/109.1

FOREIGN PATENT DOCUMENTS

| | | | |
|---|---|---|---|
| EP | 0 797 122 A1 | | 9/1997 |
| JP | A-5-142851 | | 6/1993 |
| JP | A-5-249745 | | 9/1993 |
| JP | A 09-296100 | | 11/1997 |
| JP | A 2000-026709 | | 1/2000 |
| JP | A 2000-191892 | | 7/2000 |
| JP | A 2002-003607 | | 1/2002 |
| JP | A-2002-351133 | | 12/2002 |
| JP | A 2002-351140 | | 12/2002 |
| JP | A 2004-204033 | | 7/2004 |
| JP | A 2005-049626 | | 2/2005 |
| JP | A 2005-062807 | | 3/2005 |
| JP | A 2005-108004 | | 4/2005 |
| JP | A 2006-018227 | | 1/2006 |
| JP | 2006-259455 | * | 9/2006 |
| JP | A-2007-169518 | | 7/2007 |
| JP | A-2008-129478 | | 6/2008 |
| JP | A-2008-165005 | | 7/2008 |

OTHER PUBLICATIONS

Diamond, A.S., et al., ed., Handbook of Imaging Materials, Second Edition, Marcel Dekker, Inc., NY (2002), pp. 146-148.*
Japanese Patent Office machine-assisted translation of JP 2006-259455 (pub. Sep. 2006).*
Notification from Japanese Patent Office dated Mar. 15, 2011 issued in Japanese Patent Application No. 2007-041379 (with translation).
Feb. 18, 2011 Information Statement filed in Japanese Patent Application No. 2007-041379 (with translation).

* cited by examiner

*Primary Examiner* — Janis L Dote
(74) *Attorney, Agent, or Firm* — Oliff & Berridge, PLC

(57) ABSTRACT

An electrostatic image developing toner includes a polyester resin, the electrostatic image developing toner having a sulfur element concentration S at % and a nitrogen element concentration N at % which satisfies $0.5 \leqq N/S \leqq 10$, the nitrogen element concentration N being from 0.002 at % to 2.5 at %.

14 Claims, No Drawings

ELECTROSTATIC IMAGE DEVELOPING TONER, METHOD FOR PRODUCING SAME, ELECTROSTATIC IMAGE DEVELOPER, IMAGE FORMING METHOD AND IMAGE FORMING APPARATUS

CROSS-REFERENCE TO RELATED APPLICATION

This application is based on and claims priority under 35 USC §119 from Japanese Patent Application No. 2007-41379 filed Feb. 21, 2007.

BACKGROUND (i) Technical Field

The present invention relates to an electrostatic image developing toner, a method for producing the same, an electrostatic image developer, an image forming method and an image forming apparatus.

(ii) Related Art

General polycondensation methods for obtaining a polyester resin for an electrostatic image developing toner, particularly an amorphous polyester (hereinafter also referred to as a "non-crystalline polyester"), require time far exceeding 10 hours at a high temperature exceeding 200° C. with stirring by high power and under highly reduced pressure, because of its low monomer reactivity, and such a polyester resin is produced by production methods requiring high energy.

In the case of obtaining the polyester resin low in its monomer reactivity like this, a metal catalyst having stronger activity in a high-temperature region has generally been used.

As means for preparing an aqueous dispersion of the polyester resin, there can be exemplified techniques such as a solvent method, a phase inversion emulsification method and a high-temperature emulsification method. Further, of the means for preparing an aqueous dispersion of the polyester resin, as non-solvent means using no solvent, there are also techniques such as the high-temperature emulsification method and a neutralization emulsification method (hereinafter also referred to as an "alkali neutralization method) of adding a heated alkali solution to the polyester resin to neutralize terminals of the resin, thereby allowing the resin to have solubility in water, different from the above-mentioned methods.

SUMMARY

According to an aspect of the invention, there is provided an electrostatic image developing toner comprising a polyester resin, the electrostatic image developing toner having a sulfur element concentration S at % and a nitrogen element concentration N at % which satisfy $0.5 \leqq N/S \leqq 10$, the nitrogen element concentration N being from 0.002 at % to 2.5 at %.

DETAILED DESCRIPTION

An electrostatic image developing toner according to an exemplary embodiment of the invention (hereinafter also simply referred to as the "toner") is a toner comprising at least a polyester resin, wherein the sulfur element concentration S (at %) and the nitrogen element concentration N (at %) are within the range of $0.5 \leqq N/S \leqq 10$, and above-mentioned nitrogen element concentration N is from 0.002 at % to 2.5 at %.

An exemplary embodiment of the invention will be described in detail below.

A technique using a sulfur acid as a polycondensation catalyst for a polyester is a technique which can achieve low-temperature polymerization at 150° C. or lower, so that in order to totally decrease production energy of the toner, this technique is very important for protecting the global environment.

General polycondensation methods for obtaining a polyester resin for an electrostatic image developing toner, particularly an amorphous polyester resin, require time far exceeding 10 hours at a high temperature exceeding 200° C. with stirring by high power and under highly reduced pressure, because of its low monomer reactivity, and such a polyester resin is produced by production methods requiring high energy. When the polyester resin low in its monomer reactivity like this is obtained, a metal catalyst having stronger activity in a high-temperature region has generally been used.

In such a situation, it has been found by studies of the present inventors that polycondensation of a non-crystalline polyester becomes possible even in a low-temperature region of 150° C. or lower, which is about 100° C. lower than conventional temperature, by using a sulfur element-containing acid catalyst. As a result, it has been confirmed that in terms of both a substantial decrease in environmental load caused by polycondensation in the low-temperature region and quality reservation that the occurrence of fogging in a non-image area under high temperature and high humidity can be prevented, a resin obtained by using the acid catalyst is preferably used as a raw material rather than a resin obtained by using the metal catalyst, also in image quality when used as the electrostatic image developing toner.

Further, when the toner is prepared by using the non-crystalline polyester obtained by using the metal catalyst, a bisphenol A derivative is widely used as an alcohol monomer for the polyester. However, this polyester resin is prepared by using the metal catalyst, so that a metal is incorporated in the resin, and particularly, when used under severe conditions of high temperature and high humidity, fogging becomes easy to occur in the non-image area by a decrease in charge amount caused by charge leakage.

Furthermore, in order to prepare a self-emulsifying polyester, there are a hydrophilic polymer having a specific structure and a salt thereof (sulfonylphthalic acid, for example, SDSP (taking sodium dodecylbenzenesulfonate as an example, a sulfonic acid and an alkali neutralized salt thereof). However, the use thereof in the toner resin results in a decrease in volume resistance value, particularly deterioration in electrostatic property under high temperature and high humidity, which causes an issue in practical application.

In order to totally reduce production energy of the resin and production energy of the toner, it is extremely important to avoid the conventional high-energy consumption type production method and to produce the polyester resin at a low temperature of 150° C. or lower. In order to conduct polymerization at a low temperature of 150° C. or lower about 100° C. lower than that in the conventional production method, it is preferred to use a sulfur atom-containing Bronsted acid catalyst. Further, in order to establish a toner production method under consistent low environmental load, preferred is the production using a resin particle dispersion of the non-solvent system different from the conventional emulsification method, which is improved in the above-mentioned issue at 100° C. or lower, in addition to the use of the above-mentioned low-temperature polycondensed resin as the raw material.

Methods for realizing low-temperature emulsification in the non-solvent system at 100° C. or lower include, for example, a method (hereinafter also referred to as a "neutralization emulsification method") of adding an alkali solution to a resin, followed by immersion and stirring, thereby conducting alkali neutralization (COO—) by proton elimination of a molecular chain terminal carboxyl group (COOH group) constituting the resin to impart self-emulsification force to the resin.

As a neutralizing emulsifier as a basic substance used herein, it is possible to perform emulsification with no solvent as long as it is a basic compound which can conduct neutralization reaction with a carboxyl group of a polyester resin.

For example, there may be used a metal hydroxide having a chemical formula of M(OH)n (M is an alkali metal or an alkali earth metal, and n is 1 to 3) an ammonium compound and the like.

As the neutralizing emulsifier, an alkali metal hydroxide or an alkali earth metal hydroxide is more preferred, and sodium hydroxide is still more preferred as the above-mentioned basic compound. These alkali metal and alkali earth metal hydroxides are low in volatility, different from ammonium compounds, and have an advantage that the pH control in the production is liable to become easy compared to the ammonium compounds, resulting in easy control of the neutralization rate. However, when the above-mentioned neutralizing emulsifier or an aqueous solution thereof is used, emulsification is not improbable to start in a part of the resin prior to deactivation reaction, in the case that an aqueous solution of the metal hydroxide is used as the emulsifier. Accordingly, the resin particle dispersion is prepared in some cases, as deactivation is not sufficiently performed, or there are also a fear of coloring of the resin caused by a residual metal, a fear of coloring by a catalytic effect caused by a residual acid catalyst for the low-temperature polycondensable non-crystalline polyester resin obtained by using the acid catalyst, and a fear of the occurrence of gloss unevenness of a secondary color.

In order to address the above-mentioned issues, a basic substance containing no hydroxyl group which can be deactivated from just after the termination of polycondensation to before emulsification is preferred, and particularly, an organic amine material is preferred.

There is no particular limitation on the above-mentioned organic amine material, as long as it is an organic amine such as dimethylethanolamine, diethylethanolamine, triethanolamine, tripropanolamine, tributanolamine, triethylamine, propylamine, butylamine, isopropylamine, monomethanolamine, morpholine, methoxypropylamine, pyridine or vinylpyridine. However, considering the combined use thereof as an emulsifier described later, an alkanolamine material high in solubility in water, such as triethanolamine, is more preferred, and a compound represented by the following formula (1) is still more preferred.

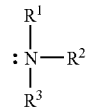

(I)

wherein $R^1$, $R^2$ and $R^3$ each independently represents a hydrogen atom, a hydrocarbon group, $—(CH_2)_n—OH$ (n is an integer of 2 to 6) or $—(CH_2)_m—O—(CH_2)_n—OH$ (m is an integer of 2 to 6, and n is an integer of 2 to 6), provided at least one of $R^1$, $R^2$ and $R^3$ contains an OH group.

$R^1$, $R^2$ and $R^3$ in formula (1) each independently represents a hydrogen atom, a hydrocarbon group, $—(CH_2)_n—OH$ (n is an integer of 2 to 6) or $—(CH_2)_m—O—(CH_2)_n—OH$ (m is an integer of 2 to 6, and n is an integer of 2 to 6), and preferably a hydrogen atom, a hydrocarbon group or $—(CH_2)_n—OH$ (n is an integer of 2 to 6).

As the compounds represented by the above-mentioned formula (1), specifically, there can be preferably exemplified dimethylethanolamine, diethylethanolamine, diethanolamine, triethanolamine, dipropanolamine, tripropanolamine, dibutanolamine, tributanolamine, monomethanolamine, monoethanolamine, monohexanolamine, dihexanolamine, trihexanolamine, 2-(dibutylamino)ethanol and the like.

Further, changes in hue of the resin with time is due to changes in absorption of visible light because a proton emitted from the acid catalyst forms a hydrogen bond with an oxygen atom of a carboxyl group to weaken the double bond ability of the carboxyl group.

In order to improve the hue stability with time, the basic material which can deactivate the acid catalyst is allowed to coexist in the resin particle dispersion. There is no particular limitation on the above-mentioned basic substance as long as it is a basic substance which can react with an acid used as the catalyst. Further, in the invention, the above-mentioned basic substance can be used not only for deactivating the acid catalyst, but also as a neutralizing emulsifier for neutralizing a terminal carboxyl group of the polyester.

Furthermore, in the invention, as a method for deactivating the acid catalyst, it is also possible to use a technique of adding an approximately equivalent to the acid catalyst amount to 2 equivalents of the basic substance at the time of termination of polycondensation to stop polycondensation, as described above, and then, adding the basic substance again at the time of emulsification of the resin. In this case, the basic substance added at the time of termination of polycondensation and the basic substance added at the time of emulsification may be the same or different.

Also in the deactivation and emulsification, a nitrogen element-containing amine, especially an alkanolamine high in hydrophilicity such as triethanolamine, is preferably used rather than a hydroxide.

The basic material contained in the resin particle dispersion which can be used in the invention may contain a polycondensation basic catalyst. When the basic catalyst is used, it is also possible to use, for example, a method of using the acid catalyst in a larger amount than the basic acid to conduct polycondensation, thereby obtaining the polyester resin, and thereafter, adding the above-mentioned basic catalyst in an amount equivalent to or more than the amount of the acid catalyst, followed by performing emulsification.

By the above-mentioned method, that is to say, by obtaining the non-crystalline polyester by the low-temperature polymerization method using the acid catalyst, without using the metal catalyst, and further, performing emulsification at 100° C. or lower using the alkanolamine, without using the solvent, the toner can be obtained according to the low environmental load production method consistent from the synthesis and emulsification of the resin to the production of the toner.

Further, no metal catalyst is used in the toner obtained according to the invention, so that when an image is printed using the above-mentioned toner, it is possible that fogging in a non-image area under high temperature and high humidity is compatible.

Further, the toner in the invention contains the sulfur (S) element and the nitrogen (N) element. The sulfur (S) element in the toner is preferably the sulfur element derived from the acid used in the synthesis of the resin, and the nitrogen (N) element in the toner is preferably the nitrogen element derived from the amine used in the deactivation of the acid catalyst and emulsification. The ratios and amounts of these S and N elements can be adjusted by the amount of the catalyst charged in the synthesis of the resin, the amount of the amine added, which is used at the time of deactivation of the acid catalyst or emulsification of the resin, the mixing time taken for deactivation after the addition of the amine, the emulsification time and the like.

The ratio of the concentration S (at %) of the sulfur element contained in the above-mentioned toner and the concentration N (at %) of the nitrogen element is $0.5 \leqq N/S \leqq 10$, preferably $0.8 \leqq N/S \leqq 9.0$, and more preferably $1 \leqq N/S \leqq 8.5$.

When the value of N/S is less than 0.5, deactivation of the acid catalyst remaining in the resin is not sufficiently performed, so that the active acid catalyst promotes coloring of the resin, resulting in the easy occurrence of changes in color of a printed toner image. On the other hand, when the value of N/S is more than 10, the amine-derived nitrogen element is contained in the toner in large amounts, so that when mixed with a pigment and wax in the production of the toner to perform heat coagulation and fusion, the particle size distribution of the toner is liable to become broad by the presence of the excess nitrogen element, and the dispersion of the pigment, wax and the like is liable to become insufficient at the time of heat coagulation and fusion. As a result, when a tertiary color process black image is printed using the above-mentioned toner, gloss unevenness becomes liable to occur in some cases.

Further, the nitrogen element concentration in the toner of the invention is from 0.002 at % to 2.5 at %.

When the nitrogen element concentration is smaller than the above-mentioned range, deactivation of the acid catalyst remaining in the resin is not sufficiently performed, so that the active acid catalyst promotes coloring of the resin, resulting in the easy occurrence of changes in color of a printed toner image. On the other hand, when the nitrogen element concentration is larger than the above-mentioned range, the amine-derived nitrogen element is contained in the toner in large amounts, so that when mixed with a pigment and wax in the production of the toner to perform heat coagulation and fusion, the particle size distribution of the toner is liable to become broad by the presence of the excess nitrogen element, and the dispersion of the pigment, wax and the like is liable to become insufficient at the time of heat coagulation and fusion. As a result, when a tertiary color process black image is printed using the above-mentioned toner, gloss unevenness becomes liable to occur in some cases.

Such sulfur element concentration S and nitrogen element concentration N can be measured by IPC (inductively coupled plasma) optical emission spectrometry or fluorescent X-ray analysis in some cases.

As the unit of the sulfur element concentration S and the nitrogen element concentration N, the percentage of the number of atoms (at %) is preferably used, and the sulfur element concentration S (at %) and the nitrogen element concentration N (at %) are preferably measured by IPC optical emission spectrometry.

Further, the ratio (N/S) of the sulfur element concentration S and the nitrogen element concentration N can also be determined as the N (mol)/S (mol) ratio in a sample.

The term "at %" means the percentage of the number of atoms, and represents the ratio of the number of the relevant atoms to the number of the total atoms in a sample.

When the above-mentioned nitrogen element concentration and sulfur element concentration are measured as at % (the percentage of the number of atoms), it is more preferred that the resin particle dispersion is dried to take out a resin component, which is dissolved in a solvent such as tetrahydrofuran to obtain an analytical solution, followed by measurement by IPC optical emission spectrometry. In the case of measurement, it is unnecessary to measure all elements. An element clearly not contained in the sample or only contained in such slight amounts that have no influence on the calculation of the numerical value may not be measured. Further, when the measurement is made by IPC optical emission spectrometry, the amount of a light element (an element at least lighter than the carbon element) which is not or can not be measured may be calculated as the amount of hydrogen atoms.

Furthermore, when the value determined using at % as the unit is converted to wt % (% by weight), it is determined by the following equation:

$$Wxi = \frac{(Axi \times Mxi)}{\left(\sum_{i=1}^{n} (Axi \times Mxi)\right)} \times 100$$

Axi: at % of element Xi

Mxi: The molecular weight of element Xi

Wxi: wt % of element Xi

Xi: The ith element n: The number of the total elements for which at % is measured or calculate In the above-mentioned equation, it is unnecessary to consider an element not detected by the measurement, an element clearly not contained, and an element only contained in such slight amounts that have no influence on the calculation of the numerical value.

Further, the pH of the resin particle dispersion in the invention is preferably from 5.5 to 10.2, more preferably from 5.8 to 10.0, and still more preferably from 6.0 to 9.8.

Within the above-mentioned range, the neutralization rate of terminal carboxyl groups of the resin can be controlled within a suitable range to obtain a sufficient solid concentration, and the particle size distribution suitable for use in the resin particle dispersion for the electrostatic image toner is obtained.

The cumulative volume average diameter $D_{50}$ of the electrostatic image developing toner of the invention is preferably from 3.0 μm to 9.0 μm, and more preferably from 3.0 μm to 5.0 μm. Within the above-mentioned numerical value range, adhesive force is moderate, developability is good, and image resolution is excellent.

Further, the volume average particle size distribution index (GSDv) of the electrostatic image developing toner of the invention is preferably 1.30 or less, more preferably 1.24 or less, and still more preferably 1.20. When the GSDv is 1.30 or less, resolution is excellent, and scattering of the toner and image defects such as fogging do not occur.

For the cumulative volume average diameter $D_{50}$ and the average particle size distribution index as used herein, a cumulative distribution curve is drawn from the smaller size side for each of the volume and the number of toner particles classified according to a particle size range (channel) divided based on the particle size distribution measured, for example, by a measuring equipment such as Coulter Counter TAII (manufactured by Beckmann Coulter) or Multisizer II (manufactured by Beckmann Coulter); and the particle sizes at an accumulation of 16% are defined as $D_{16v}$ for the volume and $D_{16p}$ for the number, the particle sizes at an accumulation of 50% are defined as $D_{50v}$ for the volume and $D_{50p}$ for the number, and the particle sizes at an accumulation of 84% are defined as $D_{84v}$ for the volume and $D_{84p}$ for the number. The volume average particle size distribution index (GSDv) is calculated as $(D_{84v}/D_{16v})^{1/2}$, and the number average particle size distribution index (GSDp) is calculated as $(D_{84p}/D_{16p})^{1/2}$ by using these values.

The shape factor SF1 of the electrostatic image developing toner of the invention is preferably from 100 to 140, and more preferably from 110 to 135, in terms of image forming properties.

The shape factor SF1 is numerically expressed by analyzing mainly microscopic images or scanning electron microscopic images with an image analyzer, and, for example, it is determined as follows. The toner shape factor SF1 is obtained by first incorporating optical microscope images of the toner particles spread on a slide glass into a Luzex image analyzer through a video camcorder, calculating SF1 of the following equation for 50 or more toner particles, and determining the average value thereof.

$$SF1=((ML)^2/A)\times(\pi/4)\times 100$$

wherein ML is the absolute maximum length of the toner particles, and A is the projection area of the toner particles.

<Polyester>

The polyester resin used in the invention (hereinafter also simply referred to as the "polyester") is obtained by polycondensation of a polycondensable monomer. The polycondensable monomers which can be used in polycondensation reaction include, for example, a polyvalent carboxylic acid, a polyol, a hydroxycarboxylic acid and mixtures of them, and it is preferred to use at least a polyvalent carboxylic acid and a polyol. As the polycondensable monomers, preferred are a polyvalent carboxylic acid and a polyol, and further, an ester compound thereof (an oligomer and/or a prepolymer), and preferred are ones which provide a polyester by direct esterification reaction or ester interchange reaction. In this case, the polyester resin obtained by polycondensation can take any form of an amorphous polyester (non-crystalline polyester) and a crystalline polyester, or a mixed form thereof.

Further, the polyester resin which can be used in the invention is preferably a terminal carboxylic acid group-containing polyester resin.

Furthermore, the polyester resin which can be used in the invention is preferably a non-crystalline polyester resin, and more preferably a non-crystalline polyester resin having a glass transition temperature Tg of 50° C. to 80° C.

(1) Polyvalent Carboxylic Acid

The polyvalent carboxylic acid is a compound having two or more carboxyl groups in a molecule thereof. Of the polyvalent carboxylic acids, a dicarboxylic acid is a compounds having two carboxyl groups in a molecule thereof, and includes oxalic acid, succinic acid, fumaric acid, maleic acid, adipic acid, β-methyladipic acid, malic acid, malonic acid, pimelic acid, tartaric acid, azelaic acid, sebacic acid, nonanedicarboxylic acid, decanedicarboxylic acid, undecanedicarboxylic acid, dodecanedicarboxylic acid, citraconic acid, cyclohexane-3,5-diene-1,2-carboxylic acid, citric acid, hexahydroterephthalic acid, mucic acid, phthalic acid, isophthalic acid, terephthalic acid, tetrachlorophthalic acid, chlorophthalic acid, nitrophthalic acid, p-carboxyphenylacetic acid, p-phenylenedipropionic acid, m-phenylenedipropionic acid, m-phenylenediacetic acid, p-phenylenediacetic acid, o-phenylenediacetic acid, diphenyldiacetic acid, diphenyl-p, p'-dicarboxylic acid, 1,1-cyclopentenedicarboxylic acid, 1,4-cyclohexanedicarboxylic acid, 1,3-cyclohexanedicarboxylic acid, 1,2-cyclohexanedicarboxylic acid, 1,2-cyclohexenedicarboxylic acid, norbornene-2,3-dicarboxylic acid, 1,3-adamantanedicarboxylicacid, 1,3-adamantanediacetic acid, naphthalene-1,4-dicarboxylic acid, naphthalene-1,5-dicarboxylic acid, naphthalene-2,6-dicarboxylic acid, anthracenedicarboxylic acid and the like.

The above-mentioned carboxylic acids may have a functional group other than the carboxyl group, and carboxylic acid derivatives such as an acid anhydride and an acid ester can also be used.

Of these polyvalent carboxylic acids, the monomers preferably used are sebacic acid, nonanedicarboxylic acid, decanedicarboxylic acid, undecanedicarboxylic acid, dodecane-dicarboxylic acid, p-phenylenediacetic acid, m-phenylene-diacetic acid, p-phenylenedipropionic acid, m-phenylenedipropionic acid, 1,4-cyclohexanedicarboxylic acid, 1,3-cyclohexanedicarboxylic acid, naphthalene-1,4-dicarboxylic acid, naphthalene-1,5-dicarboxylic acid, naphthalene-2,6-dicarboxylic acid, trimellitic acid and pyromellitic acid.

Further, as the polyvalent carboxylic acids other than the dicarboxylic acid, there are exemplified trimellitic acid, pyromellitic acid, naphthalenetricarboxylic acid, naphthalenetetracarboxylic acid, pyrenetricarboxylic acid, pyrenetetracarboxylic acid and the like, and furthermore, there are exemplified lower esters of these polyvalent carboxylic acids. In addition, acid chlorides are also not limited.

These may be used either alone or as a combination of two or more thereof.

The lower ester indicates that the number of carbon atoms of an alkoxy moiety of the ester is from 1 to 8. Specifically, there can be exemplified a methylester, an ethylester, an-propyl ester, an isopropyl ester, a n-butyl ester, an isobutyl ester and the like.

(2) Polyol

The polyol is a compound having two or more hydroxyl groups in a molecule thereof. The polyols include but are not particularly limited to the following monomers.

A diol is a compound having two hydroxyl group in a molecule thereof, and there can be exemplified propanediol, butanediol, pentanediol, hexanediol, heptanediol, octanediol, nonanediol, decanediol, dodecanediol, tetradecanediol, octadecanediol and the like.

Further, as the polyols other than the diol, there can be exemplified glycol, propanetriol, pentaerythritol, hexamethylolmelamine, hexaethylolmelamine, tetramethylolbenzoguanamine, tetraethylolbenzoguanamine and the like.

Furthermore, the polyols having a cyclic structure include the following monomers. Examples thereof include but are not limited to cyclohexanediol, cyclohexanedimethanol, bisphenol A, bisphenol C, bisphenol E, bisphenol F, bisphenol P, bisphenol S, bisphenol Z, hydrogenated bisphenol, biphenol, naphthalenediol, 1,3-adamantanediol, 1,3-adamantanedimethanol, 1,3-adamantanediethanol and the like.

In the invention, it is preferred that the above-mentioned bisphenols have at least one alkylene oxide group. The alkylene oxide groups include but are not limited to an ethylene oxide group, a propylene oxide group, a butylene oxide group and the like. Ethylene oxide and propylene oxide are suitable, and the number of moles thereof added is preferably from 1 to 3. Within this range, the viscoelasticity and glass transition temperature of the polyester to be prepared can be appropriately controlled for using it as the toner.

Of the above-mentioned monomers, monomers suitably used are hexanediol, cyclohexanediol, octanediol, decanediol, dodecanediol and respective alkylene oxide adducts of bisphenol A, bisphenol C, bisphenol E, bisphenol S and bisphenol Z.

(3) Hydroxycarboxylic Acid

The hydroxycarboxylic acid is a compound containing a carboxylic acid group and a hydroxyl group in a molecule thereof. Polycondensation can also be conducted using the hydroxycarboxylic acid compound. Examples thereof include but are not limited to hydroxyoctanoic acid, hydroxynonanoic acid, hydroxydecanoic acid, hydroxyundecanoic acid, hydroxydodecanoic acid, hydroxytetradecanoic acid, hydroxytridecanoic acid, hydroxyhexadecanoic acid, hydroxypentadecanoic acid, hydroxystearic acid and the like.

The polycondensable monomers may be used as a combination of two or more thereof at any ratio. Further, a non-crystalline resin or a crystalline resin can be easily obtained by a combination of these polycondensable monomers.

The polyester resin which can be used in the invention is preferably one obtained by polycondensation of the dicarboxylic acid and the diol, and the dicarboxylic acid may be used in a little excess to convert a molecular terminal to a carboxyl group.

When the dicarboxylic acid is used in a little excess, the dicarboxylic acid is preferably used in 0.1 to 2 mol % excess to the diol. Within the above-mentioned range, no unreacted residual monomer occurs, so that reactivity is good. Further, when the above-mentioned resin is used in the toner, it is excellent in offset properties at the time of fixing in a high-temperature region.

(4) Crystalline Polyester

For example, as the polyvalent carboxylic acids used for obtaining the crystalline polyesters, there can be exemplified oxalic acid, malonic acid, succinic acid, glutaric acid, adipic acid, pimelic acid, spelic acid, azelaic acid, sebacic acid, maleic acid, fumaric acid, citraconic acid, itaconic acid, glutaric acid, n-dodecylsuccinic acid, n-dodecenylsuccinic acid, isododecylsuccinic acid, isododecenylsuccinic acid, n-octylsuccinic acid, n-octenylsuccinic acid, acid anhydrides of them, acid chlorides of them and the like. Furthermore, acid chlorides are also not limited.

In addition, as the polyols which can be used for obtaining the crystalline polyesters, there can be exemplified ethylene glycol, diethylene glycol, triethylene glycol, 1,2-propanediol, 1,3-propanediol, 1,4-butanediol, 1,4-butenediol, neopentyl glycol, 1,5-pentanediol, 1,6-hexanediol, dipropylene glycol, polyethylene glycol, polypropylene glycol, polytetramethylene glycol and the like.

Such crystalline polyesters include a polyester obtained by reacting 1,9-nonanediol with 1,10-decanedicarboxylic acid, or cyclohexanediol with adipic acid, a polyester obtained by reacting 1,6-hexanediol with sebacic acid, a polyester obtained by reacting ethylene glycol with succinic acid, a polyester obtained by reacting ethylene glycol with sebacic acid, and a polyester obtained by reacting 1,4-butanediol with succinic acid. Of these, particularly preferred are polyesters obtained by reacting 1,9-nonanediol with 1,10-decanedicarboxylic acid, and 1,6-hexanediol with sebacic acid. However, the crystalline polyesters are not limited thereto.

(5) Non-Crystalline Polyester

Further, as the polyvalent carboxylic acids which can be used for obtaining the non-crystalline polyesters, there can be exemplified aromatic dicarboxylic acids, for example, dibasic acids such as phthalic acid, isophthalic acid, terephthalic acid, naphthalene-2,6-dicarboxylic acid, malonic acid and mesaconic acid, and lower esters of them. Furthermore, examples of the trivalent or higher-valent carboxylic acids include but are not limited to 1,2,4-benzenetricarboxylic acid, 1,3,5-benzenetricarboxylic acid, 1,2,4-naphthalenetricarboxylic acid and anhydrides of them; and sodium 2-sulfoterephthalate, sodium 5-sulfoisophthalate, sodium sulfosuccinate and lower esters of them.

As the polyhydric alcohols which can be used for obtaining the non-crystalline polyesters, there can be exemplified aliphatic, alicyclic and aromatic polyhydric alcohols. Specific examples thereof preferably include but are not limited to 1,4-cyclohexanediol, 1,4-cyclohexanedimethanol, bisphenol A, bisphenol Z, hydrogenated bisphenol A and the like.

When the polyester resin used herein is the crystalline resin, the crystal melting temperature Tm thereof is preferably from 50° C. to 120° C., and more preferably within the range of 55° C. to 90° C. When the Tm is 50° C. or higher, release properties and offset properties at the time of fixing are preferably excellent, because of good cohesive force of a binder resin itself in a high-temperature range. When the Tm is 120° C. or lower, sufficient melting is obtained, which preferably makes it difficult to elevate the lowest fixing temperature.

On the other hand, when the polyester resin is the non-crystalline resin, the glass transition temperature Tg thereof is preferably from 50° C. to 80° C., and more preferably within the range of 50° C. to 65° C. When the Tg is 50° C. or higher, release properties and offset properties at the time of fixing are preferably excellent, because of good cohesive force of a binder resin itself in a high-temperature range. When the Tg is 80° C. or lower, sufficient melting is obtained, which preferably makes it difficult to elevate the lowest fixing temperature.

For measurement of the melting temperature of the crystalline resin, a differential scanning calorimeter (DSC) is used, and the melting temperature can be determined as the melting peak temperature in the power compensation type differential scanning calorimetry as defined in JIS K-7121: 87, when measurement is made at a programmed rate of 10° C. per minute from room temperature to 150° C. Some crystalline resins may exhibit a plurality of melting peaks. In the invention, however, the maximum peak is regarded as the meting temperature. The glass transition temperature as used herein means the value determined by the method (DSC method) as defined in ASTMD 3418-82. The term "crystalline" in the above-mentioned "crystalline polyester resin" indicates to have a clear endothermic peak, not stepwise endothermic changes, in the differential scanning calorimetry (DSC). Specifically, it means that the half width value of an endothermic peak at the time when measured at a programmed rate of 10° C. per minute is 6° C. or lower. On the other hand, a resin having a half width value of an endothermic peak exceeding 6° C. or a resin having no clear endothermic peak means to be non-crystalline (amorphous).

As the polyester resin in the invention, there is preferably used a polyester resin in which 50 mol % to 100 mol % of the above-mentioned polyvalent carboxylic acid comprises a compound represented by formula (1) and/or a compound represented by formula (2), and 50 mol % to 100 mol % of the above-mentioned polyol comprises a compound represented by formula (3). By using the compound represented by formula (1) and/or the compound represented by formula (2) and the compound represented by formula (3) as main components of the polyester resin, esterification reaction with no solvent and at low temperature due to high reactivity, which has hitherto been applicable only to a crystalline resin, has become applicable also to a non-crystalline resin. Further, the aliphatic polyester has ready degradability such as excellent biodegradability. However, the above-mentioned polyester has high water resistance and heat resistance, high coating strength after curing and high reactivity at low temperature, so that energy required at the time of heat curing can be reduced.

$$R^{1}OOCA^{1}_{m}B^{1}_{n}A^{1}_{l}COOR^{1'} \quad (1)$$

($A^1$: a methylene group, $B^1$: an aromatic hydrocarbon group, $R^1$, $R^{1'}$: a hydrogen atom or a monovalent hydrocarbon group, $1 \leqq m+1 \leqq 12$, $1 \leqq n \leqq 3$)

$$R^{2}OOCA^{2}_{p}B^{2}_{q}A^{2}_{r}COOR^{2'} \quad (2)$$

($A^2$: a methylene group, $B^2$: an alicyclic hydrocarbon group, $R^2$, $R^{2'}$: a hydrogen atom or a monovalent hydrocarbon group, $0 \leqq p \leqq 6$, $0 \leqq r \leqq 6$, $1 \leqq q \leqq 3$)

$$HOX_{h}Y_{j}X_{k}OH \quad (3)$$

(X: an alkylene oxide group, Y: a bisphenol structure group, $1 \leqq h+k \leqq 10$, $1 \leqq j \leqq 3$)

The dicarboxylic acids represented by formula (1) and formula (2) and the diols represented by formula (3) will be illustrated below. In the invention, the term "carboxylicacid" includes an esterified compound thereof and an acid anhydride thereof.

$$R^{1}OOCA^{1}_{m}B^{1}_{n}A^{1}_{l}COOR^{1'} \quad (1)$$

($A^1$: a methylene group, $B^1$: an aromatic hydrocarbon group, $R^1$, $R^{1'}$: a hydrogen atom or a monovalent hydrocarbon group, $1 \leqq m+l \leqq 12$, $1 \leqq n \leqq 3$)

$$R^{2}OOCA^{2}_{p}B^{2}_{q}A^{2}_{r}COOR^{2'} \quad (2)$$

($A^2$: a methylene group, $B^2$: an alicyclic hydrocarbon group, $R^2$, $R^2$: a hydrogen atom or a monovalent hydrocarbon group, $0 \leqq p \leqq 6$, $0 \leqq r \leqq 6$, $1 \leqq q \leqq 3$)

The monovalent hydrocarbon group as used herein represents an alkyl group, an alkenyl group, an aryl group, a hydrocarbon group or a heterocyclic group containing no nitrogen atom and no sulfur atom, and these groups may have any substituent group. $R^1$, $R^{1'}$, $R^2$ and $R^{2'}$ are preferably a hydrogen atom or a lower alkyl group, more preferably a hydrogen atom, a methyl group or an ethyl group, and most preferably a hydrogen atom.

Further, the aromatic hydrocarbon group in formula (1) and the alicyclic hydrocarbon group in formula (2) may further substituted.

<Dicarboxylic Acid Represented by Formula (1)>

The dicarboxylic acid represented by formula (1) has at least one aromatic hydrocarbon group $B^1$, and the structure thereof is not particularly limited. The aromatic hydrocarbon groups $B^1$ include but are not limited to, for example, benzene, naphthalene, acenaphthylene, fluorene, anthracene, phenanthrene, tetracene, fluorancene, pyrene, benzofluorene, benzophenanthrene, chrysene, triphenylene, benzopyrene, perylene, anthrathrene, benzonaphthacene, benzochrysene, pentacene, pentaphene and coronene structures, and the like. A substituent group may be further added to these structures.

The number of the aromatic hydrocarbon groups $B^1$ contained in the dicarboxylic acid represented by formula (1) is preferably from 1 to 3. When the number is within the above-mentioned numerical value range, the polyester produced is non-crystalline, and advantageous in cost and production efficiency because the dicarboxylic acid is easily available. Further, the melting temperature and viscosity of the dicarboxylic acid represented by formula (1) is proper, and there is preferably no decrease in reactivity caused by the size and bulkiness.

When the dicarboxylic acid represented by formula (1) contains the plurality of aromatic hydrocarbon groups, the aromatic hydrocarbon groups may be directly linked to each other, or may take a structure in which another structure such as a saturated aliphatic hydrocarbon group intervenes between the aromatic hydrocarbon groups. Examples of the former include but are not limited to a biphenyl structure and the like, and examples of the later include but are not limited to a bisphenol A structure, a benzophenone structure, a diphenylethene structure and the like.

A group suitable as the aromatic hydrocarbon group $B^1$ is a structure in which a main structure thereof has 6 to 18 carbon atoms. The number of carbon atoms of the main structure does not contain the number of carbon atoms contained in a functional group attached to the main structure. Examples thereof include benzene, naphthalene, acenaphthylene, fluorene, anthracene, phenanthrene, tetracene, fluorancene, pyrene, benzofluorene, benzophenanthrene, chrysene, triphenylene and bisphenol A structures, and the like. Of these, as particularly preferred examples of the structures, there can be exemplified benzene, naphthalene, anthracene and phenanthrene. Most suitably, benzene and naphthalene structures are used.

When the main structure has 6 or more carbon atoms, the production of the monomer is easy. Further, when the main structure has 18 or less carbon atoms, the size of a monomer molecule is suitable, so that reactivity due to the restriction of molecular motion is excellent. Furthermore, the ratio of reactive functional groups in the monomer molecule is proper, so that reactivity is good.

The dicarboxylic acid represented by formula (1) contains at least one methylene group $A^1$. The methylene group may be either straight-chain or branched. For example, there can be used a methylene chain, a branched methylene chain, a substituted methylene chain or the like. In the case of the branched methylene group, it may have an unsaturated bond, a further branched or cyclic structure, or the like, irrespective of the structure of a branched moiety.

The number of the methylene groups $A^1$ is preferably from 1 to 12, and more preferably from 2 to 6, as the total of m+l in a molecule. Further, it is more preferred that m and 1 are the same number.

When the number is within the above-mentioned numerical value range, the aromatic hydrocarbon and carboxyl groups on both terminals are not directly linked to each other, so that a reaction intermediate formed by the catalyst and the dicarboxylic acid represented by formula (1) is not resonance-stabilized, resulting in excellent reactivity. Further, a straight-chain moiety does not become excessively large, compared to the dicarboxylic acid represented by formula (1), so that the polymer produced has non-crystalline characteristics, and the glass transition temperature Tg is proper.

A position at which the methylene groups $A^1$ or the carboxyl group is attached to the aromatic hydrocarbon group $B^1$ is not particularly limited, and may be any of the o-, m- and p-positions.

The dicarboxylic acids represented by formula (1) include but are not limited to 1,4-phenylenediacetic acid, 1,4-phenylenedipropionic acid, 1,3-phenylenediacetic acid, 1,3-phenylenedipropionic acid, 1,2-phenylenediacetic acid, 1,2-phenylenedipropionic acid and the like. Preferred examples thereof include 1,4-phenylenedipropionic acid, 1,3-phenylenedipropionic acid, 1,4-phenylenediacetic acid and 1,3-phenylenediacetic acid.

In the dicarboxylic acids represented by formula (1), various functional groups may be added to any of their structures. Further, the carboxylic acid group as a polycondensation reactive functional group may be an acid anhydride, an acid ester or an acid chloride. However, an intermediate of the acid ester and a proton is easily stabilized to tend to inhibit reactivity, so that the carboxylic acid, the carboxylic acid anhydride or the carboxylic acid chloride is suitably used.

<Dicarboxylic Acid Represented by Formula (2)>

The dicarboxylic acid represented by formula (2) contains an alicyclic hydrocarbon group $B^2$. There is no particular limitation on the alicyclic hydrocarbon structure, and examples thereof include but are not limited to cyclopropane, cyclobutane, cyclopentane, cyclohexane, cycloheptane, cyclooctane, cyclononane, cyclodecane, cycloundecane, cyclododecane, cyclopropene, cyclobutene, cyclopentene, cyclohexane, cycloheptene, cyclooctene, norbornene, adamantane, diamantane, triamantane, tetraamantane, iseane and twistane structures, and the like. Further, a substituent group may be added to these structures. Considering stability of the structure and the size and bulkiness of the molecule, cyclobutane, cyclopentane, cyclohexane, norbornene and adamantane structures and the like are preferred.

The number of the alicyclic hydrocarbon groups contained in this monomer is preferably from 1 to 3. When the number is within the above-mentioned numerical value range, the polyester produced is non-crystalline, and excellent in reactivity by an increase in melting temperature and the size and bulkiness of the molecule. When the plurality of alicyclic hydrocarbon groups are contained, the alicyclic hydrocarbon groups may be directly linked to each other, or may take a structure in which another structure such as a saturated aliphatic hydrocarbon group intervenes between the alicyclic hydrocarbon groups. Examples of the former include but are not limited to a dicyclohexyl structure and the like, and examples of the later include but are not limited to a hydrogenated bisphenol A structure and the like.

A group suitable as the alicyclic hydrocarbon group has 3 to 12 carbon atoms. The number of carbon atoms of the main structure does not contain the number of carbon atoms contained in a functional group attached to the main structure. Examples thereof include to cyclopropane, cyclobutane, cyclopentane, cyclohexane, norbornene and adamantane structures, and the like. Of these, as particularly preferred examples of the structures, there can be exemplified cyclobutane, cyclopentane, cyclohexane, norbornene and adamantane structures.

The dicarboxylic acid represented by formula (2) may have a methylene group $A^2$ in its structure. The methylene group may be either straight-chain or branched. For example, there can be used a methylene chain, a branched methylene chain, a substituted methylene chain or the like. In the case of the branched methylene group, it may have an unsaturated bond, a further branched or cyclic structure, or the like, irrespective of the structure of a branched moiety.

For the number of methylene groups $A^2$, p and r are each 6 or less. When p and r are each 6 or less, a straight-chain moiety has a proper size, compared to the dicarboxylic acid represented by formula (2), so that the polymer produced is non-crystalline, and the glass transition temperature Tg is proper.

A position at which the methylene groups $A^2$ or the carboxyl group is attached to the alicyclic hydrocarbon group $B^2$ is not particularly limited, and may be any of the o-, m- and p-positions.

The dicarboxylic acids represented by formula (2) include but are not limited to 1,1-cyclopropanedicarboxylic acid, 1,1-cyclobutanedicarboxylic acid, 1,2-cyclobutanedicarboxylic acid, 1,1-cyclopentenedicarboxylic acid, 1,4-cyclohexanedicarboxylic acid, 1,3-cyclohexanedicarboxylic acid, 1,2-cyclohexanedicarboxylic acid, 1,2-cyclohexenedicarboxylic acid, norbornene-2,3-dicarboxylic acid, adamantanedicarboxylic acid and the like. Of these, preferably used is cyclobutane, cyclohexane or a compound having a cyclohexane structure, and particularly preferred are 1,3-cyclohexanedicarboxylic acid and 1,4-cyclohexanedicarboxylic acid.

Further, in the dicarboxylic acids represented by formula (2), various functional groups may be added to any of their structures. Furthermore, the carboxylic acid group as a polycondensation reactive functional group may be an acid anhydride, an acid ester or an acid chloride. However, an intermediate of the acid ester and a proton is easily stabilized to tend to inhibit reactivity, so that the carboxylic acid, the carboxylic acid anhydride or the carboxylic acid chloride is suitably used.

In the invention, the compound (dicarboxylic acid) represented by the above-mentioned formula (1) and/or formula (2) is preferably contained in an amount of 50 mol % to 100 mol % based on the total of the polycarboxylic acid components. The compounds represented by the above-mentioned formula (1) and the compounds represented by the above-mentioned formula (2) may be used either alone or as a combination thereof.

When the ratio of the compound represented by the above-mentioned formula (1) and/or formula (2) is less than 50 mol %, reactivity in low-temperature polycondensation can be sufficiently exhibited, and the polyester having the high degree of polymerization and good molecular weight is obtained. Further, only a small amount of residual polycondensation components remain, so that deterioration in performance such as stickiness of the cured product at ordinary temperature does not occur. Further, the viscoelasticity and glass transition temperature thereof are proper.

The polyester resin which can be used in the invention is more preferably a resin obtained by using the compound represented by the above-mentioned formula (1) and/or formula (2) in an amount of 60 mol % to 100 mol %, and still more preferably a resin obtained by using the compound represented by the above-mentioned formula (1) and/or formula (2) in an amount of 80 mol % to 100 mol %.

<Diol Represented by Formula (3)>

The polyester resin which can be used in the invention is a resin obtained by polycondensation reaction of the polycarboxylic acid and the polyol, and 50 mol % to 100 mol % of the polyol comprises the compound (diol) represented by formula (3):

$$HOX_hY_jX_kOH \quad (3)$$

(X: an alkylene oxide group, Y: a bisphenol structure group, $1 \leqq h+k \leqq 10$, $1 \leqq j \leqq 3$)

The diol represented by the above-mentioned formula (3) contains at least one bisphenol structure Y. The bisphenol structure is not particularly limited, as long as it is a structure constituted by two phenol groups. Examples thereof include but are not limited to bisphenol A, bisphenol C, bisphenol E, bisphenol F, bisphenol M, bisphenol P, bisphenol S, bisphenol Z and the like. As the structures suitably used, there can be exemplified bisphenol A, bisphenol C, bisphenol E, bisphenol F, bisphenol M, bisphenol P, bisphenol S and bisphenol Z, and more suitably bisphenol A, bisphenol E and bisphenol F.

The number j of the bisphenol structures is from 1 to 3. When j is within the above-mentioned range, the non-crystalline resin is obtained. Further, the viscosity and melting temperature are proper, and reactivity is excellent.

The diol represented by the above-mentioned formula (3) has at least one alkylene oxide group. The alkylene oxide groups include but are not limited to an ethyleneoxide group, a propylene oxide group, a butylene oxide group and the like.

Suitable are an ethylene oxide group and a propylene oxide group, and particularly suitable is an ethylene oxide group.

The total number h+k of the alkylene oxide groups is from 1 to 10 in a molecule thereof. Within the above-mentioned range, the non-crystalline resin is obtained. Further, reactivity is excellent, polymerization well proceeds, and it is possible to obtain a resin having a high molecular weight.

Further, in order to promote homogeneous reaction, it is preferred that h and k is the same number. Furthermore, the total number h+k of the alkylene oxide groups is preferably 6 or less, and the numbers h and k of the alkylene oxide groups are more preferably each 2, or each 1. In addition, when the diol has two or more alkylene oxide groups, it may have two or more kinds of alkylene oxide groups in a molecule thereof.

The diols represented by formula (3) include but are not limited to bisphenol A-ethylene oxide adduct (h+k is from 1 to 10), bisphenol A-propylene oxide adduct (h+k is from 1 to 10), ethylene oxide-propylene oxide adduct (h+k is from 2 to 10), bisphenol Z-ethylene oxide adduct (h+k is from 1 to 10), bisphenol Z-propylene oxide adduct (h+k is from 1 to 10), ), bisphenol S-ethylene oxide adduct (h+k is from 1 to 10), bisphenol S-propylene oxide adduct (h+k is from 1 to 10), ), biphenol-propylene oxide adduct (h+k is from 1 to 10), ), bisphenol F-ethylene oxide adduct(h+k is from 1 to 10), bisphenol F-propylene oxide adduct (h+k is from 1 to 10), ), bisphenol E-ethylene oxide adduct (h+k is from 1 to 10), bisphenol E-propylene oxide adduct (h+k is from 1 to 10), ), bisphenol C-ethylene oxide adduct (h+k is from 1 to 10), bisphenol C-propylene oxide adduct (h+k is from 1 to 10), ), bisphenol M-ethylene oxide adduct (h+k is from 1 to 10), bisphenol M-propylene oxide adduct (h+k is from 1 to 10), ), bisphenol P-ethylene oxide adduct (h+k is from 1 to 10), bisphenol P-propylene oxide adduct (h+k is from 1 to 10) and the like. Particularly preferred examples include bisphenol A-ethylene oxide 1 mol adduct (h and k are each 1), bisphenol A-ethylene oxide 2 mol adduct (h and k are each 2), bisphenol A-propylene oxide 1 mol adduct (h and k are each 1), bisphenol A-ethylene oxide 1 mol propylene oxide 2 mol adduct, bisphenol E-ethylene oxide 1 mol adduct (h and k are each 1), bisphenol F-ethylene oxide 1 mol adduct (hand k are each 1) and bisphenol F-propylene oxide 1 mol adduct (h and k are each 1).

In the invention, the diol represented by formula (3) is contained in the polyol in an amount of 50 mol % to 100 mol %. When the content is within the above-mentioned range, reactivity in low-temperature polycondensation can be sufficiently exhibited, and the polyester having the high degree of polymerization and good molecular weight is obtained. Further, only a small amount of residual polycondensation components remain, so that deterioration in performance such as stickiness of the cured product at ordinary temperature does not occur. Further, the viscoelasticity and glass transition temperature thereof are proper.

The polyester resin which can be used in the invention is a resin obtained by using the diol represented by the above-mentioned formula (3) more preferably in an amount of 60 mol % to 100 mol %, and still more preferably in an amount of 80 mol % to 100 mol %.

In the invention, the dicarboxylic acid represented by formula (1) and/or formula (2) and the diol represented by formula (3) can be each used as a resin forming composition either in the monomer state, or in the oligomer or polymer state. In the case of the oligomer or the polymer, the molecular weight Mw thereof is preferably from 300 to 30,000, and more preferably from 300 to 25,000. When the molecular weight is within this range, film formation is possible by known methods, and it becomes possible to further perform curing after film formation.

The weight average molecular weight of the above-mentioned polyester obtained by polycondensation of the polycondensable monomers is preferably from 1,500 to 55,000, and more preferably from 3,000 to 45,000. When the weight average molecular weight is 1,500 or more, the cohesive force of the binder resin is good, and hot offset properties are excellent. When it is 55,000 or less, the hot offset lowest fixing temperature preferably shows an excellent value. Further, the polyester may have a partially branched structure, a crosslinked structure or the like by selection of the carboxylic acid value or alcohol valence of the monomers.

Further, in the invention, an addition polymerizable monomer, preferably a radical polymerizable monomer, can also be further added as needed, in addition to the polycondensable monomer, and polycondensation and addition polymerization may be conducted concurrently or separately to form a composite material. The addition polymerizable monomers include, for example, a cationic polymerizable monomer and a radical polymerizable monomer. However, a radical polymerizable monomer is preferred.

Specific examples of the radical polymerizable monomers used in this case include aromatic vinyl compounds, such as α-substituted styrenes such as styrene, α-methylstyrene and α-ethylstyrene, nucleus-substituted styrenes such as m-methylstyrene, p-methylstyrene and 2,5-dimethylstyrene, and nucleus-substituted halogenated styrenes such as p-chlorostyrene, p-bromostyrene and dibromostyrene; unsaturated carboxylic acids such as (meth)acrylic acid (wherein the term "(meth)acrylic" means "acrylic" and "methacrylic", and hereinafter the same), crotonic acid, maleic acid, fumaric acid, citraconic acid and itaconic acid; unsaturated carboxylic acid esters such as methyl (meth)acrylate, ethyl (meth)acrylate, propyl (meth)acrylate, butyl (meth)acrylate, pentyl (meth)acrylate, hexyl (meth)acrylate, 2-ethylhexyl (meth) acrylate, glycidyl (meth)acrylate and benzyl (meth)acrylate; unsaturated carboxylic acid derivatives such as (meth)acrylaldehyde, (meth)acrylonitrile and (meth) acrylamide; N-vinyl compounds such as N-vinylpyridine and N-vinylpyrrolidone; vinyl esters such as vinyl formate, vinyl acetate and vinyl propionate; vinyl halide compounds such as vinyl chloride, vinyl bromide and vinylidene chloride; N-substituted unsaturated amides such as N-methylolacrylamide, N-ethylolacrylamide, N-propanolacrylamide, N-methylolmaleinamic acid, N-methylolmaleinamic acid ester, N-methylolmaleimide and N-ethylolmaleimide; conjugated dienes such as butadiene and isoprene; polyfunctional vinyl compounds such as divinylbenzene, divinylnaphthalene and divinylcyclohexane; polyfunctional acrylates such as ethylene glycol di(meth)acrylate, diethylene glycol di(meth)acrylate, propylene glycol di(meth)acrylate, tetramethylene glycol di(meth) acrylate, neopentyl glycol di(meth)acrylate, hexamethylene glycol di(meth)acrylate, trimethylolpropane di(meth)acrylate, trimethylolpropane tri(meth)acrylate, glycerol di(meth) acrylate, glycerol tri(meth)acrylate, pentaerythritol di(meth) acrylate, pentaerythritol tri(meth)acrylate, pentaerythritol tetra(meth)acrylate, dipentaerythritol di(meth)acrylate, dipentaerythritol tri(meth)acrylate, dipentaerythritol tetra (meth)acrylate, dipentaerythritol penta(meth)acrylate, dipentaerythritol hexa(meth)acrylate, sorbitol penta (meth)acrylate and sorbitol hexa(meth)acrylate; and the like. Of these, N-substituted unsaturated amides, conjugated dienes, polyfunctional vinyl compounds and polyfunctional acrylates can also induce crosslinking reaction in the polymer formed.

These can be used either alone or in combination.

As polymerization methods for the above-mentioned addition polymerizable monomer, particularly the radical polymerizable monomer, there can be used known methods such as a method using a radical polymerization initiator, a self-polymerization method by heat, and a method using UV irradiation. In the method using a radical polymerization initiator, the radical initiator is available as either an oil-soluble or a water-soluble one. However, either of them may be used. Specific examples of the radical initiators include azobisnitriles such as 2,2'-azobis(2-methylpropionitrile), 2,2'-azobis(2-methylbutyronitrile), 2,2'-azobisisobutyronitrile, 2,2'-azobis(2,4-dimethylvaleronitrile), 2,2'-azobis(2,4-dimethyl-4-methoxyvaleronitrile), 1,1'-azobis(cyclohexanecarbonitrile) and 2,2'-azobis(2-amidinopropane) hydrochloride; organic peroxides such as diacyl peroxides such as acetyl peroxide, octanoyl peroxide, 3,5,5-trimethylhexanoyl peroxide, decanoyl peroxide, lauroyl peroxide and benzoyl peroxide, dialkyl peroxides such as di-t-butyl peroxide, t-butyl-α-cumyl peroxide and dicumyl peroxide, peroxyesters such as t-butyl peroxyacetate, α-cumyl peroxypivalate, t-butyl peroxyoctoate, t-butyl peroxyneodecanoate, t-butyl peroxylaurate, t-butyl peroxybenzoate, di-t-butyl peroxyphthalate and di-t-butyl peroxyisophthalate, hydroperoxides such as t-butyl hydroperoxide, 2,5-dimethylhexane 2,5-dihydroperoxide, cumen hydroperoxide and di-isopropylbenzene hydroperoxide and peroxycarbonates such as t-butyl peroxyisopropylcarbopnate; inorganic peroxides such as hydrogen peroxide; persulfates such as potassium persulfate, sodium persulfate and ammonium persulfate; and the like. A redox polymerization initiator can also be used in combination therewith. Further, a chain transfer agent may be used at the time of addition polymerization. There is no particular limitation on the chain transfer agent, and one having a covalent bond of a carbon atom and a sulfur atom is preferred. Specific examples thereof preferably include thiols.

In the invention, in order to maintain the average particle size of a polyester-containing material (oil phase) comprising the above-mentioned addition polymerizable monomer in a specific range, a co-surfactant can be used in combination therewith. As the co-surfactant, there can be used one which is insoluble or slightly soluble in water and soluble in monomer, and has been used in "mini-emulsion polymerization" previously known and described in detail later.

Preferred examples of the co-surfactants include alkanes having 8 to 30 carbon atoms such as dodecane, hexadecane and octadecane, alkyl alcohols having 8 to 30 carbon atoms such as lauryl alcohol, cetyl alcohol and stearyl alcohol, alkyl (meth)acrylates having 8 to 30 carbon atoms such as lauryl (meth)acrylate, cetyl (meth)acrylate and stearyl (meth)acrylate, alkyl mercaptans having 8 to 30 carbon atoms such as lauryl mercaptan, cetyl mercaptan and stearyl mercaptan, polymers such as polystyrene and polymethyl methacrylate, polyadducts, carboxylic acids, ketones, amines and the like.

<Colorant>

The colorants which can be used in the toner of the invention include, for example, various pigments such as carbon black, chrome yellow, Hansa yellow, benzidine yellow, threne yellow, quinoline yellow, permanent orange GTR, pyrazolone orange, Balcan orange, watchung red, permanent red, brilliant carmine 3B, brilliant carmine 6B, Dupont oil red, pyrazolone red, lithol red, rhodamine B lake, lake red C, rose Bengal, aniline blue, ultramarine blue, Calco oil blue, methylene blue chloride, phthalocyanine blue, phthalocyanine green, malachite green oxalate and titanium black; various dyes such as acridine-based, xanthene-based, azo-based, benzoquinone-based, azine-based, anthraquinone-based, thioindigo-based, dioxazine-based, thiazine-based, azomethine-based, indigo-based, phthalocyanine-based, aniline black-based, polymethine-based, triphenylmethane-based, diphenylmethane-based, thiazole-based and xanthene-based dyes; and the like. Specifically, as the above-mentioned colorants, there can be preferably used, for example, carbon black, nigrosine dye (C.I. No. 50415B), aniline blue (C.I. No. 50405), Calco oil blue (C.I. No. azoic blue 3), chrome yellow (C.I. No. 14090), ultramarine blue (C.I. No. 77103), Dupont oil red (C.I. No. 26105), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266), rose Bengal (C.I. No. 45435), a mixture thereof and the like.

The amount of the colorant used is preferably from 0.1 to 20 parts by weight, and particularly preferably from 0.5 to 10 parts by weight, based on 100 parts by weight of the toner. Further, as the colorant, these pigments and dyes can be used either alone or as a combination of two or more thereof.

As a method for dispersing these colorants, there can be used any method, for example, a common dispersing method using a rotary shearing type homogenizer or a media-containing ball mill, sandmill or Dynomill, and it is not limited at all. These colorant particles may be added to a mixing solvent together with another particle component at once, or may be dividedly added in multiple stages.

The electrostatic image developing toner of the invention may contain a magnetic substance or a characteristic improving agent. The above-mentioned magnetic substances include metals or alloys exhibiting ferromagnetism, such as iron, cobalt and nickel including ferrite and magnetite, compounds containing these elements, alloys which contain no ferromagnetic element, but come to exhibit ferromagnetism by appropriate heat treatment, for example, an alloy called a "heusler alloy" containing manganese and copper, such as manganese-copper-aluminum or manganese-copper-tin, chromium dioxide and the like. For example, when obtaining a black toner, magnetite which is black itself and also fulfills a function as a colorant can be particularly preferably used. Further, when obtaining a color toner, a colorant which is less blackish such as metallic iron is preferred. Further, of these magnetic substances, some act as a colorant. In that case, they may be used both as the magnetic substance and the colorant. When obtaining the magnetic toner, the content of the magnetic substance is preferably from 20 to 70 parts by weight, and more preferably from 40 to 70 parts by weight, based on 100 parts by weight of the toner.

The above-mentioned characteristic improving agents include a fixability improving agent, a charge controlling agent and the like. As the fixability improving agents, there can be used a polyolefin, a metal salt of a fatty acid, a fatty acid ester, fatty acid ester-based wax, a partially saponified fatty acid ester, a higher fatty acid, a higher alcohol, liquid or solid paraffin wax, polyamide-based wax, a polyhydric alcohol ester, silicone vanish, aliphatic fluorocarbon and the like. In particular, wax having a softening temperature (the ring and ball method: JIS K 2531) of 60° C. to 150° C. is preferred. As the charge controlling agents, there can be used ones which have hitherto been know, and examples thereof include a nigrosine-based dye, a metal-containing dye and the like.

Further, in the toner of the invention, inorganic particles such as a fluidity improving agent are preferably used as a mixture. The above-mentioned inorganic particles have a primary particle size of preferably 5 nm to 2 μm, and more preferably 5 nm to 500 nm. Furthermore, the specific surface area by the BET method is preferably from 20 $m^2/g$ to 500 $m^2/g$. The ratio thereof mixed in the toner is preferably from 0.01% by weight to 5% by weight, and more preferably from 0.01% by weight to 2.0% by weight. Such inorganic particles include, for example, silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride and the like, and silica powder is particularly preferred.

The term silica powder as used herein means a powder having a Si—O—Si bond, and includes both powders manufactured by the dry method and the wet method. In addition to silicon dioxide anhydride, any of aluminum silicate, sodium silicate, potassium silicate, magnesium silicate, zinc silicate and the like may be used, but it is preferred to contain $SiO_2$ in an amount of 85% by weight or more. As specific examples of the silica powder, there are various commercially available silica products, and those having hydrophobic groups on their surfaces are preferred. Examples thereof include AEROSIL R-972, R-974, R-805 and R-812 (the above are manufactured by Nippon Aerosil Co., Ltd.), Talax 500 (manufactured by Talco Co., Ltd.) and the like. In addition, there can be used silica powder treated with a silane coupling agent, a titanium coupling agent, a silicon oil or a silicon oil having an amine at a side chain thereof, and the like.

After the resulting toner is dried in the same manner as with an ordinary toner, inorganic particles such as silica, alumina, titania or calcium carbonate, or resin particles such as a vinyl resin, a polyester or a silicone can be added to surfaces of the toner particles in a dry state with applying shear stress to use, for the purpose of imparting fluidity or improving cleaning properties.

Further, when adhered to the surface of the toner in an aqueous medium, all inorganic particles generally used as an external additive to the surface of the toner, such as silica, alumina, titania, calcium carbonate, magnesium carbonate and tricalcium phosphate, can be used by dispersing them with an ionic surfactant, a polymer acid or a polymer base.

In the electrostatic image developing toner of the invention, the charge controlling agent used in the toner of this type may be used as needed. In that case, the charge controlling agent may be added as an aqueous dispersion at the time of initiation of the production of the above-mentioned monomer particle emulsion, initiation of polymerization or initiation of the coagulation of the above-mentioned resin particles. The amount of the charge controlling agent added is preferably from 1 to 25 parts by weight, and more preferably from 5 to 15 parts by weight, based 100 parts by weight of the monomer or polymer.

As the charge controlling agents, there can be used known ones, for example, positively chargeable charge controlling agents such as a nigrosine-based dye, a quaternary ammonium salt-based compound, a triphenylmethane-based compound, an imidazole-based compound and a polyamine-based resin, negatively chargeable charge controlling agents such as an azo-based dye containing a metal such as chromium, cobalt, aluminum or iron, a salt or complex of a metal such as chromium, zinc and aluminum and a hydroxycarboxylic acid such as salicylic acid, alkylsalicylic acid or benzilic acid, an amide compound, a phenol compound, a naphthol compound and a phenolamide compound, and the like.

Further, in the electrostatic image developing toner of the invention, a wax as a release agent used in the toner of this type may be used as needed. In that case, the release agent may be added as an aqueous dispersion at the time of initiation of the production of the above-mentioned monomer emulsion, initiation of polymerization or initiation of the coagulation of the above-mentioned resin particles. The amount of the release agent added is preferably from 1 to 25 parts by weight, and more preferably from 5 to 15 parts by weight, based 100 parts by weight of the monomer or polymer.

As the release agents, there can be used known ones, for example, polyolefinic waxes such as low-molecular weight polyethylene, low-molecular weight polypropylene and an ethylene-propylene copolymer, paraffin waxes, plant waxes such as hydrogenated caster oil, carnauba wax and rice wax, higher fatty acid ester-based waxes such as a stearic acid ester, a behenic acid ester and montanic acid ester, alkyl-modified silicones, higher fatty acids such as stearic acid, higher alcohols such as stearyl alcohol, higher fatty acid amides such as oleic acid amide and stearic acid amide and long-chain alkyl group-containing ketones such as distearyl ketone.

Further, in the electrostatic image developing toner of the invention, various known internal additives such as an antioxidant and an UV absorber used in the toner of this type may be used as needed.

(Production Method of Electrostatic Image Developing Toner)

A method for producing the electrostatic image developing toner of the invention comprises the steps of obtaining a polyester resin by polycondensation of a polycondensable monomer using a sulfur acid as a polycondensation catalyst (hereinafter also referred to as the "polycondensation step", obtaining a resin particle dispersion by emulsion-dispersing the above-mentioned polyester resin in an aqueous medium using a nitrogen atom-containing compound (hereinafter also referred to as the "dispersing step"), obtaining coagulated particles by coagulating the above-mentioned resin particles in a dispersion containing the above-mentioned resin particle dispersion, and fusing the above-mentioned coagulated particles together by heating.

The electrostatic image developing toner of the invention is preferably the toner produced by the above-mentioned production method.

In the production method of the electrostatic image developing toner of the invention, for example, a resin particle dispersion obtained by emulsion-dispersing the polyester resin obtained by polycondensation using the sulfur acid as the polycondensation catalyst is mixed with a colorant particle dispersion and a release agent particle dispersion, a coagulant is further added to generate hetero coagulation, thereby forming coagulated particles of the toner, and thereafter the above-mentioned coagulated particles are fused and unified by heating at a temperature equivalent to or higher than the glass transition temperature or melting temperature of the resin particles, followed by washing and drying, thereby obtaining the electrostatic image developing toner of the invention. As for the shape of the toner, amorphous to spherical forms are preferably used. Further, as the coagulant, there can be preferably used an inorganic salt and a divalent or higher valent metal salt, as well as a surfactant. In particular, when a metal salt is used, it is preferred n terms of coagulation control and toner electrostatic property.

Further, it is also possible to previously coagulate the resin particle dispersion and colorant particle dispersion in the above-mentioned coagulation step to form a first coagulated particles, and thereafter, further to add the resin particle dispersion or a resin particle dispersion different from the above to form a second shell layer on surfaces of the first particles. Although the colorant dispersion is separately prepared in this exemplification, the colorant may be previously incorporated, of course, into the resin particles in the above-mentioned resin particle dispersion.

In the invention, a method for forming the coagulated particles is not particularly limited, and there are used known coagulation methods which have hitherto been used in emulsion polymerization coagulation methods of the electrostatic image developing toner, for example, a method of reducing stability of an emulsion by a rise in temperature, a change in pH, salt addition or the like and stirring the emulsion with a disperser or the like. Further, for the purpose of inhibiting oozing of the colorant from the surfaces of the particles, the surfaces of the particles may be crosslinked by heat treatment after coagulation treatment. The surfactant and the like used may be removed by water washing, acid washing, alkali washing or the like as needed.

The resin particle dispersion which can be used in the invention is preferably produced by a production method shown below.

The production method of the resin particle dispersion which can be used in the invention is preferably a method comprising the steps of obtaining a polyester resin by polycondensation of a polycondensable monomer using a sulfur acid as a polycondensation catalyst, and obtaining a resin particle dispersion by emulsion-dispersing the above-mentioned polyester resin in an aqueous medium using a nitrogen atom-containing compound.

Further, the above-mentioned production method of the resin particle dispersion may contain other steps described later or any known step as needed.

(1) Polycondensation Step

The production method of the electrostatic image developing toner of the invention preferably comprises the step of obtaining the polyester resin by polycondensation of the polycondensable monomer using the sulfur acid as the polycondensation catalyst.

As the above-mentioned sulfur acids, ones described above can be used, and the preferred range thereof is also the same.

In polycondensation of the polycondensable monomer in the invention, a polycondensation catalyst is preferably used, because the rate of reaction can be increased. At the time of polycondensation, the known polycondensation catalyst can also be previously incorporated into the polycondensable monomer as needed. Further, in order to polycondense the polycondensable monomer at a low temperature of preferably 150° C. or lower, more preferably 100° C. or lower, the polycondensation catalyst is generally used.

As the polycondensation catalyst, a well-known polycondensation catalyst can be used. There can also be used an acid-based catalyst, a rear earth-containing catalyst, a hydrolytic enzyme or the like. The acid-based catalyst is preferably used, and the sulfur acid is more preferably used among others. Further, as the polycondensation catalyst, a salt of the acid-based catalyst can also be used.

Furthermore, an acid having a surface-active effect may also be used. The acid having a surface-active effect is an acid having a structure comprising a hydrophobic group and a hydrophilic group, and having an acid structure in which at least the hydrophilic group partially comprises a proton.

The sulfur acid is an oxygen acid of sulfur, and includes an inorganic sulfur acid, an organic sulfur acid and the like.

The inorganic sulfur acids include sulfuric acid, sulfurous acid, salts of them and the like, and the organic sulfur acids include sulfonic acids such as an alkylsulfonic acid, an arylsulfonic acid and salts of them, and organic sulfuric acids such as an alkylsulfuric acid, an arylsulfuric acid and salts of them.

As the sulfur acid, preferred is the organic sulfur acid, and more preferred is the organic sulfur acid having a surface-active effect. The acid having a surface-active effect is an acid having a structure comprising a hydrophobic group and a hydrophilic group, having an acid structure in which at least the hydrophilic group partially comprises a proton, and having both an emulsifying function and a catalytic function.

The organic sulfur acids include, for example, an alkylbenzenesulfonic acid, an alkylsulfonic acid, an alkyldisulfonic acid, an alkylphenolsulfonic acid, an alkylnaphthalenesulfonic acid, an alkyltetralinsulfonic acid, an alkylallylsulfonic acid, a petroleum sulfonic acid, an alkylbenzimidazolesulfonic acid, a higher alcohol ether sulfonic acid, an alkyldiphenylsulfonic acid, a long-chain alkylsulfuric acid ester, a higher alcohol sulfuric ester, a higher alcohol ether sulfuric acid ester, a higher fatty acid amide alkylolsulfuric acid ester, a higher fatty acid, a sulfosuccinic acid ester, a resin acid alcohol sulfuric acid and salt compounds of all of these. A plurality of them may be used in combination, as needed. Specific examples thereof included odecylbenzenesulfonic acid, isopropylbenzenesulfonic acid, comphorsulfonic acid, p-toluenesulfonic acid, monobutyl-phenylphenol sulfuric acid, dibutyl-phenylphenol sulfuric acid, dodecylsulfuric acid, naphthenyl alcohol sulfuric acid and the like. Further, these sulfur acids may have some functional groups in their structures.

Of the organic sulfur acids described above, the organic sulfur acids having a surface-active effect include an organic sulfur acid having an alkyl group having 7 to 20 carbon atoms or an aralkyl group having 13 to 26 carbon atoms, and dodecylbenzenesulfonic acid, pentadecylbenzenesulfonic acid, dodecylsulfuric acid and the like are preferably exemplified.

In the invention, when the sulfur acids are used, they may be used either alone or as a combination of two or more thereof.

As acids having a surface-active effect other than the above, which can be used in combination with the sulfur acids, there can be exemplified various fatty acids, a sulfonated higher fatty acid, a higher alkylphosphoric acid ester, a resin acid, naphthenic acid and salt compounds of all of these.

These polycondensation catalysts may be used either alone or as a combination of a plurality thereof. Further, these catalysts can be recovered and regenerated as needed.

Further, the above-mentioned sulfur acid and a basic substance may be used together with each other as the polycondensation catalyst at the time of polycondensation. For example, there can be used a salt of the sulfur acid and the basic substance, a mixture of the sulfur acid and the basic substance, or the like.

When the sulfur acid and the basic substance are used together at the time of polycondensation, they may be mixed at the time of polycondensation or may be previously mixed to use. Further, the sulfur acid and the basic substance may be previously reacted with each other and isolated as a salt of the sulfur acid to use, or they may be formed by salt exchange or the like in a polycondensation reaction system.

When the above-mentioned sulfur acid and basic substance are used in combination with each other, particularly, coloring can be more suppressed than the case of only the sulfur acid, and the environmental dependency of static electrification in the toner using the polyester resin as a binder resin can be suppressed. The environmental dependency of the toner due to deterioration in electrostatic property caused by the remaining sulfur acid can also be prevented. This is therefore preferred. This is believed that the basic substance reacts with the sulfur acid remaining in the reaction system to inhibit coordination of the sulfur acid to an ester bonding site, which prevents coloring.

As the basic substance which can be used in combination with the sulfur acid at the time of polycondensation, there can be preferably used a basic substance which can be used at the time of the termination of polycondensation described later, dispersion, emulsion dispersion and the like, and the basic substance which can be used in combination with the sulfur acid may be the same as or different from the basic substance which can be used at the time of the termination of polycondensation described later, dispersion, emulsion dispersion and the like.

The ratio of the sulfur acid and the basic substance used at the time of polycondensation is preferably within the range of (the acid amount of sulfur acid)/(the base amount of basic substance)=1/0.1 to 1/1, particularly preferably 1/0.1 to 1/0.5, by molar ratio.

The reaction temperature of polycondensation reaction in the above-mentioned polycondensation step is preferably lower than the conventional reaction temperature. The reaction temperature is preferably from 70° C. to 150° C., more preferably from 70° C. to 140° C., and still more preferably from 80° C. to lower than 140° C. The reaction temperature is preferably 70° C. or higher, because the solubility of the monomer and the degree of catalytic activity do not decrease, reactivity is sufficiently high, and suppression of extension of the molecular weight does not occur. Further, the reaction temperature is preferably 150° C. or lower, because an object of a low-energy production method can be achieved. Further, coloring of the resin caused by high temperature and decomposition of the polyester formed are preferably difficult to occur. Furthermore, the reaction time at the time of polycondensation is preferably from 0.5 to 72 hours, and more preferably from 1 to 48 hours, although it depends on the reaction temperature.

The polycondensation reaction in the above-mentioned polycondensation step can be conducted by general polycondensation methods such as bulk polymerization, underwater polymerization such as emulsion polymerization and suspension polymerization, solution polymerization and interfacial polymerization. However, bulk polymerization or underwater polymerization is suitably used. Further, for the purpose of obtaining a high-molecular weight polyester, general conditions such as the reaction under reduced pressure and a steam of nitrogen can be widely used.

The polycondensation reaction in the above-mentioned polycondensation step may be conducted in an aqueous medium. The aqueous medium which can be used in the polycondensation reaction is the same as the aqueous medium described above, and the preferred range is also the same.

The polycondensation reaction in the above-mentioned polycondensation step may be conducted by using an organic solvent. Specific examples of the organic solvents which can be used in the invention include hydrocarbon-based solvents such as toluene, xylene and mesitylene; halogen-based solvents such as chlorobenzene, bromobenzene, iodobenzene, dichlorobenzene, 1,1,2,2-tetrachloroethane and p-chlorotoluene; ketone-based solvents such as 3-hexanone, acetophenone and benzophenone; ether-based solvents such as dibutyl ether, anisole, phenetole, o-dimethoxybenzene, p-dimethoxybenzene, 3-methoxytoluene, dibenzyl ether, dibenzyl phenyl ether, methoxynaphthalene and tetrahydrofuran; thioether solvents such as phenyl sulfide and thioanisole; ester-based solvents such as ethyl acetate, butyl acetate, pentyl acetate, methyl benzoate, methyl phthalate, ethyl phthalate and cellosolve acetate; and diphenyl ether-based solvents such as diphenyl ether, alkyl-substituted diphenyl ethers such as 4-methylphenyl ether, 3-methylphenyl ether and 3-phenoxytoluene, halogen-substituted diphenyl ethers such as 4-bromphenyl ether, 4-chlorophenyl ether, 4-bromodiphenyl ether and 4-methyl-4'-bromodiphenyl ether, alkoxy-substituted diphenyl ethers such as 4-methoxydiphenyl ether, 4-methoxyphenyl ether, 3-methoxyphenyl ether and 4-methyl-4'-methoxydiphenyl ether, and cyclic diphenyl ethers such as dibenzofuran and xanthene. These may be used as a mixture. One which can be easily separated from water is preferred as the solvent. In particular, in order to obtain the polyester having a high average molecular weight, preferred are ester-based solvents, ether-based solvents and diphenyl ether-based solvents, and particularly preferred are alkylarylether-based solvents and ester-based solvents.

Furthermore, also in the invention, in order to obtain the binder resin having a high average molecular weight, a dehydrating demonomerizing agent may be added to the organic solvent. Specific examples of the dehydrating demonomerizing agents include, for example, molecular sieves such as molecular sieve 3A, molecular sieve 4A, molecular sieve 5A and molecular sieve 13X; alumina, silicagel, calciumchloride, calciumsulfate, diphosphorus pentoxide, concentrated sulfuric acid, magnesium perchlorate, barium oxide, calcium oxide, potassium hydroxide and sodium hydroxide; metal hydrides such as calcium hydride, sodium hydride and lithium aluminum hydride; alkali metals such as sodium; and the like. Molecular sieves are preferred among others in terms of easy handling and recovery.

(2) Dispersing Step

The production method of the electrostatic image developing toner of the invention preferably comprises the step of obtaining a resin particle dispersion by emulsion-dispersing the above-mentioned polyester resin in an aqueous medium using a nitrogen atom-containing compound. In the above-mentioned dispersing step, a surfactant or the like is preferably added to perform dispersing, for an increase in dispersion efficiency and improvement in stability of the resin particle dispersion.

A method for dispersing and granulating the above-mentioned polyester in an aqueous medium can also be selected from known methods such as a forced emulsification method, a self-emulsification method and a phase inversion emulsification method. Of these, a self-emulsification method and a phase inversion emulsification method are preferably applied, considering energy necessary for the emulsification, controllability of the particle size of the emulsified product, stability and the like. The self-emulsification method and the phase conversion emulsification method are described in "Application Technology of Superfine Polymer Particles" (CMC Publishing Co., Ltd.).

When the organic solvent is used in the above-mentioned dispersing step, the above-mentioned production method of the resin particle dispersion may comprise the steps of at least partially removing the organic solvent and forming the resin particles. For example, it is preferred that after the material containing the terminal carboxyl group-containing polyester has been emulsified, the organic solvent is partially removed, thereby performing solidification as particles. Specific examples of solidification include a method of emulsion—dispersing the above-mentioned polyester-containing material in an aqueous medium, and then, removing the organic solvent by drying in a gas-liquid interface with stirring while introducing air or inert gas such as nitrogen (a waste air drying method), a method of performing drying under reduced pressure while bubbling a solution with inert gas as needed (a topping method under reduced pressure), a method of discharging an emulsified dispersion in which the polyester-containing material is emulsion-dispersed in an aqueous medium or an emulsion of the polyester-containing material from fine nozzles like a shower, dropping it on a dish-shaped receiver, and repeating this operation to dry it (a shower type desolvation method), and the like. It is preferred that these methods are appropriately selected or combined, depending on the rate of evaporation of the organic solvent used, the solubility in water and the like, to perform desolvation.

Further, methods for dispersing and granulating the above-mentioned polyester include, for example, a suspension polymerization method in an aqueous medium, a solution suspension method, a miniemulsion method, a microemulsion method, a multistage swelling method, an emulsion polymerization method containing seed polymerization, and the like, at the time when the above-mentioned polyester is produced.

There is no particular limitation on the basic substance used in the case of dispersing the polycondensed resin in an aqueous medium, and alkali hydroxides (NaOH, KOH, LiOH), organic amines and the like can be used. As the basic substance used in emulsion dispersion from just after the termination of polycondensation, a hydroxyl group-free basic substance is preferably used as a main component rather than the alkali hydroxide, and particularly, an organic amine-based material is preferred. The above-mentioned amine-based materials include dimethylethanolamine, diethylethanolamine, triethanolamine, tripropanolamine, tributanolamine, triethylamine, propylamine, butylamine, isopropylamine, monomethanolamine, morpholine, methoxypropylamine, pyridine, vinylpyridine and the like, and there is no particular limitation thereon as long as it is an organic amine. However, considering that it is also used as an emulsifier, an alkanolamine having high solubility in water, such as triethanolamine, is more preferred, and the compound represented by the above-mentioned formula (1) is still more preferred.

The dispersing medium of the resin particle dispersion, which can be used in the invention, is an aqueous medium. The aqueous media which can be used in the invention include, for example, water such as distilled water and ion exchanged water, alcohols such as ethanol and methanol, and the like. Of these, preferred are ethanol and water, and particularly preferred is water such as distilled water and ion exchanged water. These may be used either alone or as a combination of two or more thereof. Further, the aqueous medium may contain a water-miscible organic solvent. The water-miscible organic solvents include, for example, acetone, acetic acid and the like.

When the above-mentioned polyester is dispersed in the aqueous medium, the above-mentioned respective materials are dispersed in the aqueous medium using, for example, mechanical shear, ultrasonic waves or the like. In the case of this dispersion, it is also possible to add a surfactant, a polymer dispersant, an inorganic dispersant or the like into the aqueous medium as needed. Further, the aqueous medium may be added into a polyester-containing mixture (oil phase) to finally emulsion-disperse the polyester in the aqueous medium.

A surfactant described below can also be added to the resin particle dispersion in which the polyester is dispersed in the aqueous medium, for an increase in dispersion efficiency and improvement in stability of the resin particle dispersion. The surfactants which can be used in the invention include, for example, anionic surfactants such as a sulfuric acid ester salt-based surfactant, a sulfonic acid salt-based surfactant and a phosphoric acid ester-based surfactant; cationic surfactants such as an amine salt type surfactant and a quaternary ammonium salt type surfactant; nonionic surfactants such as a polyethylene glycol-based surfactant, an alkylphenol ethylene oxide adduct-based surfactant and a polyhydric alcohol-based surfactant; and the like. Of these, anionic surfactants and cationic surfactants are preferred. The above-mentioned nonionic surfactant is preferably used together with the above-mentioned an ionic surfactant or cationic surfactant. The above-mentioned surfactants may be used alone or as a combination of two or more thereof.

The anionic surfactants include sodium dodecylbenzenesulfonate, sodium alkylnaphthalenesulfonate, sodium arylalkylpolyether sulfonate, sodium 3,3'-disulfone-diphenylurea-4,4'-diazo-bis-amino-8-naphthol-6-sulfonate, ortho-carboxybenzene-azo-dimethylaniline, sodium 2,2',5,5'-tetramethyltriphenylmethane-4,4'-diazo-bis-β- naphthol-6-sulfonate, sodiumdialkyl sulfosuccinate, sodiumdodecylsulfate, sodium tetradecylsulfate, sodium pentadecylsulfate, sodium octylsulfate, sodium oleate, sodium laurate, sodium caprate, sodium caprylate, sodium capronate, potassium stearate, calcium oleate and the like.

The cationic surfactants include, for example, alkylbenzendimethylammonium chloride, alkyltrimethylammonium chloride, distearylammonium chloride and the like.

The nonionic surfactants include, for example, polyethylene oxide, polypropylene oxide, a combination of polypropylene oxide and polyethylene oxide, an ester of polyethylene glycol and a higher fatty acid, alkylphenol polyethylene oxide, an ester of a higher fatty acid and polyethylene glycol, an ester of a higher fatty acid and polypropylene oxide, a sorbitan ester and the like.

Further, a polymer dispersant or a stabilizing aid may be added to the above-mentioned resin particle dispersion. As the polymer dispersants, there can be exemplified sodium polycarboxylate and polyvinyl alcohol, and as the inorganic dispersants, there can be exemplified calcium carbonate and the like. However, the invention is not to be construed as being limited thereto.

Further, in order to prevent the Ostwald ripening phenomenon of the monomer emulsion particles in the aqueous medium, a higher alcohol represented by heptanol or octanol, or a higher aliphatic hydrocarbon represented by hexadecane is also preferably incorporated as the stabilizing aid.

The toner obtained by the above-mentioned production method of the electrostatic image developing toner preferably has an average particle size of 1 μm to 10 μm, and the colorant is contained in the particles in an amount of preferably 0.1 to 50 parts by weight, more preferably 0.5 to 40 parts by weight, particularly preferably 1 to 25 parts by weight, based on 100 parts by weight of the above-mentioned polyester.

<Addition Polymerization Type Resin Particle Dispersion>

In the above-mentioned production method of the electrostatic image developing toner, an addition polymerization type resin particle dispersion prepared by emulsion polymerization or the like, which has hitherto been known, can be used together in addition to the crystalline polyester resin particle dispersion and the non-crystalline polyester resin particle dispersion. The resin particles in the addition polymerization type resin particle dispersion which can be used in the invention preferably has a median size of 0.1 μm to 2.0 μm, similarly to the above-mentioned resin particle dispersion.

As examples of the addition polymerizable monomers for preparing these addition polymerization type resin particle dispersions, there can be preferably exemplified the above-mentioned addition polymerizable monomers. In the case of the addition polymerizable monomer, emulsion polymerization is conducted using an ionic surfactant or the like to be able to prepare the resin particle dispersion, and in the case of the other resins, when soluble in a solvent which is oily and has relatively low solubility in water, the resin is dissolved in such a solvent, and dispersed in particle form in the aqueous medium together with an ionic surfactant or a polymer electrolyte with a dispersing apparatus such as a homogenizer. Then, the solvent is evaporated by heating or pressure reduction, thereby being able to obtain the resin particle dispersion. Further, the above-mentioned polymerization initiator or chain transfer agent can also be used at the time of polymerization of the addition polymerizable monomer.

<Electrostatic Image Developer>

The electrostatic image developing toner of the invention can be used as an electrostatic image developer. The electrostatic image developer of the invention is not particularly limited as long as it contains the electrostatic image developing toner, and may take an appropriate component composition according to its purpose. When the electrostatic image developing toner is used alone, the developer is prepared as a one-component system electrostatic image developer, whereas when the toner is used in combination with a carrier, the developer is prepared as a two-component system electrostatic image developer. Although the carrier which can be used in the invention is not particularly limited, examples thereof usually include a magnetic particle such as iron powder, ferrite, iron oxide powder or nickel; a resin-coated carrier in which a surface of a magnetic particle as a core material is coated with a resin such as a styrene-based resin, a vinyl-based resin, an ethylenic resin, a rosin-based resin, a polyester-based resin or a melamine-based resin or with a wax such as stearic acid to form a resin coat layer; a magnetic material dispersion-type carrier in which magnetic particles are dispersed in a binder resin; and the like. Of these, a resin-coated carrier is particularly preferred because the toner chargeability or the resistance of the entire carrier can be controlled by the constitution of the resin coat layer.

The mixing ratio of the toner of the invention and the carrier in the two-component system electrostatic image developer is usually from 2 to 10 parts by weight of toner per 100 parts by weight of carrier. Although a preparation method of the developer is not particularly limited, examples thereof include a method of mixing them using, for example, a V blender or the like.

(Image Forming Method)

The image forming method of the invention is an image forming method comprising a latent image forming step of forming an electrostatic latent image on a surface of a latent image carrier, a developing step of developing the electrostatic latent image formed on the surface of the above-mentioned latent image carrier with a developer containing a toner to form a toner image, a transfer step of transferring the toner image formed on the surface of the above-mentioned latent image carrier to a surface of a material to which the toner image is to be transferred, and a fixing step of fixing the toner image transferred to the surface of the above-mentioned material to which the toner image is to be transferred, wherein the electrostatic image developing toner of the invention is used as the above-mentioned toner, or the electrostatic image developer of the invention is used as the above-mentioned developer. According to the image forming method of the invention, the developer is prepared using the specific toner as described above, and the electrostatic image is formed and developed by a normal electrophotographic copying machine using the same. The resulting toner image is electrostatically transferred onto transfer paper, and fixed by a heat roller fixing device in which the temperature of a heat roller is set to a constant temperature to form the copied image. When such high-speed fixing that the contact time of the toner on the transfer paper with the heat roller is 1 second or less and particularly 0.5 second or less is performed, the image forming method of the invention is particularly preferably used.

Further, the electrostatic image developer (electrostatic image developing toner) of the invention can be used in an image forming method of a normal electrostatic image developing system (electrophotographic system). Specifically, the image forming method of the invention comprises, for example, the electrostatic latent image forming step, the toner image forming step, the transfer step and the cleaning step. The above-mentioned respective steps are general steps themselves, and described in JP-A-56-40868, JP-A-49-91231 and the like. The image forming method of the invention is carried out using an image forming apparatus such as a copying machine or a facsimile machine, which is known per se.

The above-mentioned electrostatic latent image forming step is a step of forming the electrostatic latent image on the electrostatic latent image carrier. The above-mentioned toner image forming step is a step of developing the above-mentioned electrostatic latent image with a developer layer on a developer carrier to form the toner image. The above-mentioned developer layer is not particularly limited, as long as it contains the electrostatic image developer of the invention containing the above-mentioned electrostatic image developing toner of the invention. The above-mentioned transfer step is a step of transferring the above-mentioned toner image onto a transfer material. The above-mentioned cleaning step is a step of removing the electrostatic image developer remaining on the electrostatic latent image carrier.

In the image forming method of the invention, an embodiment further comprising a recycling step is preferred. The above-mentioned recycling step is a step of transferring the electrostatic image developing toner recovered in the above-mentioned cleaning step to the developer layer. The image forming method of the embodiment comprising this recycling step can be carried out by using an image forming apparatus such as a toner recycling system type copying machine or facsimile machine. Further, this method can also be applied to a recycling system in which the cleaning step is omitted and the toner is recovered simultaneously with the development.

(Image Forming Apparatus)

The image forming apparatus of the invention comprises a latent image carrier; a charging unit that charges the latent image carrier; an exposing unit that exposes the charged latent image carrier with light to form a electrostatic latent image on the latent image carrier; a developing unit that contains a developer and develops the electrostatic latent image with the developer to form a toner image; and a transfer unit that transfers the toner image from the latent image carrier to a recording material, the developer including the above descried electrostatic image developing toner. In embodiments, the image forming apparatus comprises an electrostatic latent image carrier, a charging means for charging the electrostatic latent image carrier, an exposing means for exposing the holder charged by the charging mean to light according to image information to form an electrostatic latent image, a developing means for developing the electrostatic latent image with a developer to form a toner image, and a transfer means for transferring the toner image from the holder to a material on which the toner image is to be recorded. The image forming apparatus further comprises a fixing means for fixing the toner image on a fixing base material, as needed. In the above-mentioned transfer means, transfer may be performed twice or more using an intermediate transfer member.

For the above-mentioned electrostatic latent image carrier and respective means, the constitution described in each step of the above-mentioned image forming method can be preferably used.

For all the above-mentioned respective means, means known in the image forming apparatus can be utilized. Further, the image forming apparatus used in the invention may comprise a means, apparatus and the like other than the above-mentioned constitution. Furthermore, in the image forming apparatus used in the invention, two or more of the above-mentioned means may be used at the same time.

EXAMPLES

The invention will be illustrated in detail with reference to examples. Parts are by weight.

<Preparation of Resin P1 and Resin Particle Dispersion L1>

| (Preparation of Resin P1) | |
|---|---|
| Bisphenol A Ethylene Oxide 2 mol Adduct | 24.66 parts |
| Bisphenoxyethanolfluorene | 8.55 parts |
| 1,4-Cyclohexanedicarboxylic Acid | 16.80 parts |
| Dodecylbenzenesulfonic Acid | 0.128 part |

The above-mentioned materials were mixed and placed in a reactor equipped with a stirrer, and polycondensation was conducted in an open system for 16 hours so as to give a resin temperature of 120° C. As a result, homogeneous transparent non-crystalline polyester resin P1 was obtained.

Then, a small amount of a resin sample was collected, and the following physical characteristics were measured.

Weight Average Molecular Weight by GPC: 18,150

Glass Transition Temperature: 65° C.

In the measurement of the above-mentioned molecular weight, the weight average molecular weight Mw and the number average molecular weight Mn were measured under the conditions described below by gel permeation chromatography (GPC). The measurement was performed at a temperature of 40° C. by allowing a solvent (tetrahydrofuran) to flow at a flow rate of 1.2 ml/min, and injecting a tetrahydrofuran sample solution having a concentration of 0.2 g/20 ml in an amount of 3 mg as the weight of a sample. In the measurement of the molecular weight of the sample, the measurement conditions were selected so that the molecular weight of the sample is included in the range where the logarithm of the molecular weight and the count number in a calibration curve produced from several kinds of monodisperse polystyrene standard samples formed a straight line.

By the way, the reliability of the measurement results can be confirmed by that an NBS706 polystyrene standard sample measured under the above-mentioned conditions shows:

Weight average molecular weight $Mw=28.8\times10^4$

Number average molecular weight $Mn=13.7\times10^4$

Further, as columns of GPC, there were used TSK-GEL, GMH (produced by Tosoh Corp.) and the like which satisfy the above-mentioned conditions.

For the measurement of the glass transition temperature Tg of the polyester, a differential scanning calorimeter (DSC50, manufactured by Shimadzu Corp.) was used.

Thirty parts of resin P1 obtained as described above was weighed, and placed in a reactor similarly provided with a stirrer. Then, 0.35 part of triethanolamine was added, and stirring was performed at 100° C. for 10 minutes to obtain resin P1'.

(Preparation of Resin Particle Dispersion L1)

To resin P1' obtained as described above, 45 parts of ion exchanged water heated at 90° C. was added, and stirring was continued for 2 hours to obtain an aqueous polyester dispersion.

Then, the presence or absence of the undispersed resin in the resin particle dispersion stirred in a homogenizer (manufactured by IKA Works, Inc., Ultra-Turrax T50) for 3 minutes was confirmed. As a result, the resin was entirely dispersed in water, and no undispersed resin was observed at all. Thus, the resin particle dispersion having a solid content of 40% was obtained.

By the above-mentioned method, non-crystalline polyester resin particle dispersion L1 having a median resin particle size of 190 nm and a pH of 8.1 was obtained. The particle size of the resulting resin particle dispersion was measured with a laser diffraction type particle size distribution measuring device (manufactured by Horiba Ltd., LA-920).

Further, resin particle dispersion L1 was dried to collect a resin component, and the S content and the N content were measured by ICP optical emission spectrometry. The results thereof are as described in Table 1, and the N/S ratio was 1.18.

Furthermore, for air-dried matter of the resin particle dispersion, the residual metal concentration was measured by the fluorescent X-ray analysis. As a result, it was equal to or less than the detection limit.

<Preparation Method of Air-Dried Matter>

Air-dried matter of the resin particle dispersion may be prepared by known methods. From the viewpoint of preventing impurities from being adsorbed, it is preferred that the air-dried matter is prepared in a reduced pressure atmosphere using a dryer such as a vacuum dryer. However, it is also possible to obtain the air-dried matter in the atmosphere.

In the following examples, drying was performed in a reduced pressure atmosphere of −0.1 MPa and 30° C. for 18 hours, using a square vacuum constant-temperature dryer (Vacuum Drying Oven DP33) manufactured by Yamato Scientific Co., Ltd.

<Fluorescent X-Ray Measurement>

In this measurement, the residual metal concentration is measured by the fluorescent X-ray measurement method. The measurement method will be described below.

As pretreatment of a sample for measurement, 6 g of the air-dried matter or toner of the resin particle dispersion was pressure molded by a pressure molding machine under pressure conditions of 10 t for 1 minute. The measurement was made by all-element analysis using a fluorescent X-ray analyzer (XRF-1500) manufactured by Shimadzu Corp. under measuring conditions of an X-ray tube voltage of 40 KV and an X-ray tube current of 90 mA.

The term "equal to or less than the detection limit" of a measuring device means the case where the Net intensity of a subject peak of a measurement element is equal to or less than the intensity of a background.

<ICP Optical Emission Spectrometry>

The measurement of the element concentration of each of N and S was made by using ICPS-7000 manufactured by Shimadzu Corp., preparing a working solution for each of the S element and the N element, and performing quantitative analysis.

<Preparation of Resin P2 and Resin Particle Dispersion L2>

| (Preparation of Resin P2) | |
|---|---|
| Bisphenol A Propylene Oxide 2 mol Adduct | 27.444 parts |
| Bisphenoxyethanolfluorene | 8.536 parts |
| 1,4-Cyclohexanediacetic Acid | 16.271 parts |
| Dodecylbenzenesulfonic Acid | 0.0792 part |

The above-mentioned materials were mixed and placed in a reactor equipped with a stirrer, and polycondensation was conducted in an open system for 16 hours so as to give a resin temperature of 120° C. As a result, homogeneous transparent non-crystalline polyester resin P2 was obtained.

A small amount of a resin sample was collected, and the following physical characteristics were measured.

Weight Average Molecular Weight by GPC: 16,540

Glass Transition Temperature: 68° C.

Thirty parts of resin P2 obtained as described above was weighed, and placed in a reactor similarly provided with a stirrer. Then, 4.98 parts of diethanolamine was added, and stirring was performed at 100° C. for 10 minutes to conduct mixing, thereby obtaining resin P2'.

(Preparation of Resin Particle Dispersion L2)

To resin P2' obtained as described above, 45 parts of ion exchanged water heated at 90° C. was added, and stirring was continued for 2 hours to obtain an aqueous polyester dispersion.

Then, the presence or absence of the undispersed resin in the resin particle dispersion stirred in a homogenizer (manufactured by IKA Works, Inc., Ultra-Turrax T50) for 3 minutes was confirmed. As a result, the resin was entirely dispersed in water, and no undispersed resin was observed at all. Thus, the resin particle dispersion having a solid content of 40% was obtained.

By the above-mentioned method, non-crystalline polyester resin particle dispersion L2 having a median resin particle size of 190 nm and a pH of 9.50 was obtained. The particle size of the resulting resin particle dispersion was measured with a laser diffraction type particle size distribution measuring device (manufactured by Horiba Ltd., LA-920).

Further, for the resulting resin particle dispersion, the S content and the N content were measured by ICP. The results thereof are as described in Table 1, and the N/S ratio was 385.7.

Furthermore, for air-dried matter of the resulting resin particle dispersion, the residual metal concentration was measured by the fluorescent X-ray analysis. As a result, it was equal to or less than the detection limit.

<Preparation of Resin P3 and Resin Particle Dispersion L3>

| (Preparation of Resin P3) | |
|---|---|
| Bisphenol Z Ethylene Oxide 2 mol Adduct | 34.10 parts |
| 1,4-Phenylenediacetic Acid | 15.90 parts |
| Dodecylbenzenesulfonic Acid | 0.313 part |

The above-mentioned materials were mixed and placed in a reactor equipped with a stirrer, and polycondensation was conducted in an open system for 16 hours so as to give a resin temperature of 120° C. As a result, homogeneous transparent non-crystalline polyester resin P3 was obtained.

A small amount of a resin sample was collected, and the following physical characteristics were measured.

Weight Average Molecular Weight by GPC: 13,950

Glass Transition Temperature: 63° C.

Thirty parts of resin P3 obtained as described above was weighed, and placed in a reactor similarly provided with a stirrer. Then, 0.015 part of monoethanolamine was added, and stirring was performed at 100° C. for 10 minutes to conduct mixing, thereby obtaining resin P3'.

(Preparation of Resin Particle Dispersion L3)

To resin P3' obtained as described above, 45 parts of ion exchanged water heated at 90° C. was added, and stirring was continued for 2 hours to obtain an aqueous polyester dispersion.

Then, the presence or absence of the undispersed resin in the resin particle dispersion stirred in a homogenizer (manufactured by IKA Works, Inc., Ultra-Turrax T50) for 3 minutes was confirmed. As a result, the resin was entirely dispersed in water, and no undispersed resin was observed at all. Thus, the resin particle dispersion having a solid content of 40% was obtained.

By the above-mentioned method, non-crystalline polyester resin particle dispersion L3 having a median resin particle size of 220 nm and a pH of 6.20 was obtained. The particle size of the resulting resin particle dispersion was measured with a laser diffraction type particle size distribution measuring device (manufactured by Horiba Ltd., LA-920).

Further, for the resulting resin particle dispersion, the S content and the N content were measured by ICP. The results thereof are as described in Table 1, and the N/S ratio was 1.10.

Furthermore, for air-dried matter of the resulting resin particle dispersion, the residual metal concentration was measured by the fluorescent X-ray analysis. As a result, it was equal to or less than the detection limit.

<Preparation of Resin P4 and Resin Particle Dispersion L4>

| (Preparation of Resin P4) | |
|---|---|
| Bisphenol A Propylene Oxide 2 mol Adduct | 26.2 parts |
| Bisphenoxyethanolfluorene (BPEF) | 8.20 parts |
| 1,4-Phenylenediacetic Acid | 15.78 parts |
| Dodecylbenzenesulfonic Acid | 3.475 parts |

The above-mentioned materials were mixed and placed in a reactor equipped with a stirrer, and polycondensation was conducted in an open system for 16 hours so as to give a resin temperature of 120° C. As a result, homogeneous transparent non-crystalline polyester resin P4 was obtained.

A small amount of a resin sample was collected, and the following physical characteristics were measured.

Weight Average Molecular Weight by GPC: 18,890

Glass Transition Temperature: 65° C.

Thirty parts of resin P4 obtained as described above was weighed, and placed in a reactor similarly provided with a stirrer. Then, 52.7 part of tributanolamine was added, and stirring was performed at 100° C. for 16 hours to conduct mixing, thereby obtaining resin P4'.

(Preparation of Resin Particle Dispersion L4)

To resin P4' obtained as described above, 45 parts of ion exchanged water heated at 90° C. was added, and stirring was continued for 2 hours to obtain an aqueous polyester dispersion.

Then, the presence or absence of the undispersed resin in the resin particle dispersion stirred in a homogenizer (manufactured by IKA Works, Inc., Ultra-Turrax T50) for 3 minutes was confirmed. As a result, the resin was entirely dispersed in water, and no undispersed resin was observed at all. Thus, the resin particle dispersion having a solid content of 40% was obtained.

By the above-mentioned method, non-crystalline polyester resin particle dispersion L4 having a median resin particle size of 170 nm and a pH of 9.45 was obtained. The particle size of the resulting resin particle dispersion was measured with a laser diffraction type particle size distribution measuring device (manufactured by Horiba Ltd., LA-920).

Further, for the resulting resin particle dispersion, the S content and the N content were measured by ICP. The results thereof are as described in Table 1, and the N/S ratio was 66.25.

Furthermore, for air-dried matter of the resulting resin particle dispersion, the residual metal concentration was measured by the fluorescent X-ray analysis. As a result, it was equal to or less than the detection limit.

<Preparation of Resin P5 and Resin Particle Dispersion L5>

| (Preparation of Resin P5) | |
|---|---|
| Bisphenol A Propylene Oxide 2 mol Adduct | 26.2 parts |
| Bisphenoxyethanolfluorene (BPEF) | 8.20 parts |
| 1,4-Phenylenediacetic Acid | 15.78 parts |
| Dodecylbenzenesulfonic Acid | 0.007 part |

The above-mentioned materials were mixed and placed in a reactor equipped with a stirrer, and polycondensation was conducted in an open system for 16 hours so as to give a resin temperature of 190° C. As a result, homogeneous transparent non-crystalline polyester resin P5 was obtained.

A small amount of a resin sample was collected, and the following physical characteristics were measured.

Weight Average Molecular Weight by GPC: 17,770

Glass Transition Temperature: 65° C.

Thirty parts of resin P5 obtained as described above was weighed, and placed in a reactor similarly provided with a stirrer. Then, 0.04 part of triethanolamine was added, and stirring was performed at 100° C. for 10 minutes to conduct mixing, thereby obtaining resin P5'.

(Preparation of Resin Particle Dispersion L5)

To resin P5' obtained as described above, 45 parts of ion exchanged water heated at 90° C. was added, and stirring was continued for 2 hours to obtain an aqueous polyester dispersion.

Then, the presence or absence of the undispersed resin in the resin particle dispersion stirred in a homogenizer (manufactured by IKA Works, Inc., Ultra-Turrax T50) for 3 minutes was confirmed. As a result, the resin was entirely dispersed in water, and no undispersed resin was observed at all. Thus, the resin particle dispersion having a solid content of 40% was obtained.

By the above-mentioned method, non-crystalline polyester resin particle dispersion L5 having a median resin particle size of 200 nm and a pH of 6.4 was obtained. The particle size of the resulting resin particle dispersion was measured with a laser diffraction type particle size distribution measuring device (manufactured by Horiba Ltd., LA-920).

Further, for the resulting resin particle dispersion, the S content and the N content were measured by ICP. The results thereof are as described in Table 1, and the N/S ratio was 1.08.

Furthermore, for air-dried matter of the resulting resin particle dispersion, the residual metal concentration was measured by the fluorescent X-ray analysis. As a result, it was equal to or less than the detection limit.

<Preparation of Resin P6' and Resin Particle Dispersion L6>

(Preparation of Resin P6')

Thirty parts of resin P1 obtained as described above was weighed, and placed in a reactor similarly provided with a stirrer. Then, 0.03 part of triethanolamine was added, and stirring was performed at 100° C. for 10 minutes to obtain resin P6'.

(Preparation of Resin Particle Dispersion L6)

Resin P6' obtained as described above was stirred in a homogenizer (manufactured by IKA Works, Inc., Ultra-Turrax T50) for 3 minutes, and then, the presence or absence of the undispersed resin in the resin particle dispersion was confirmed. As a result, it was confirmed that the resin was not entirely dispersed in water, and that the undispersed resin was present. The solid concentration of the resulting resin particle dispersion was measured. As a result, the solid content was 11.0%.

By the above-mentioned method, non-crystalline polyester resin particle dispersion L6 having a median resin particle size of 840 nm and a pH of 5.89 was obtained.

Further, for the resulting resin particle dispersion, the S content and the N content were measured by ICP. The results thereof are as described in Table 2, and the N/S ratio was 0.11.

Furthermore, for air-dried matter of the resulting resin particle dispersion, the residual metal concentration was measured by the fluorescent X-ray analysis. As a result, it was equal to or less than the detection limit.

<Preparation of Resin P7' and Resin Particle Dispersion L7>

(Preparation of Resin P7')

Resin P2" was obtained in the same manner as in the production of resin P2 with the exception that the amount of dodecylbenzenesulfonic acid was changed from 0.0792 part to 0.0392 part.

Thirty parts of resin P2" obtained as described above was weighed, and placed in a reactor similarly provided with a stirrer. Then, 0.03 part of triethanolamine was added, and stirring was performed at 100° C. for 10 minutes to obtain resin P7'.

(Preparation of Resin Particle Dispersion L7)

Resin P7' obtained as described above was stirred in a homogenizer (manufactured by IKA Works, Inc., Ultra-Turrax T50) for 3 minutes, and then, the presence or absence of the undispersed resin in the resin particle dispersion was confirmed. As a result, it was confirmed that the resin was not entirely dispersed in water, and that the undispersed resin was present. The solid concentration of the resulting resin particle dispersion was measured. As a result, the solid content was 6.8%.

By the above-mentioned method, non-crystalline polyester resin particle dispersion L7 having a median resin particle size of 3,550 nm and a pH of 9.9 was obtained.

Further, for the resulting resin particle dispersion, the S content and the N content were measured by ICP. The results thereof are as described in Table 2, and the N/S ratio was 952.38.

Furthermore, for air-dried matter of the resulting resin particle dispersion, the residual metal concentration was measured by the fluorescent X-ray analysis. As a result, it was equal to or less than the detection limit.

<Preparation of Resin P8' and Resin Particle Dispersion L8>

(Preparation of Resin P8')

Resin P4" was obtained in the same manner as in the production of resin P4 with the exception that the amount of dodecylbenzenesulfonic acid was changed from 3.475 parts to 34.75 parts.

Thirty parts of resin P4" obtained as described above was weighed, and placed in a reactor similarly provided with a stirrer. Then, 50.0 parts of monoethanolamine was added, and stirring was performed at 100° C. for 16 hours to obtain resin P8'.

(Preparation of Resin Particle Dispersion L8)

Resin P8' obtained as described above was stirred in a homogenizer (manufactured by IKA Works, Inc., Ultra-Turrax T50) for 3 minutes, and then, the presence or absence of the undispersed resin in the resin particle dispersion was confirmed. As a result, it was confirmed that the resin was not entirely dispersed in water, and that the undispersed resin was present. The solid concentration of the resulting resin particle dispersion was measured. As a result, the solid content was 3.8%.

By the above-mentioned method, non-crystalline polyester resin particle dispersion L8 having a median resin particle size of 6,600 nm and a pH of 9.9 was obtained.

Further, for the resulting resin particle dispersion, the S content and the N content were measured by ICP. The results thereof are as described in Table 2, and the N/S ratio was 10.05.

Furthermore, for air-dried matter of the resulting resin particle dispersion, the residual metal concentration was measured by the fluorescent X-ray analysis. As a result, it was equal to or less than the detection limit.

<Preparation of Resin P9' and Resin Particle Dispersion L9>

(Preparation of Resin P9')

Thirty parts of resin P5 obtained as described above was weighed, and placed in a reactor similarly provided with a stirrer. Then, 0.017 part of triethanolamine was added, and stirring was performed at 100° C. for 10 minutes to obtain resin P9'.

(Preparation of Resin Particle Dispersion L9)

Resin P9' obtained as described above was stirred in a homogenizer (manufactured by IKA Works, Inc., Ultra-Turrax T50) for 3 minutes, and then, the presence or absence of the undispersed resin in the resin particle dispersion was confirmed. As a result, it was confirmed that the resin was not entirely dispersed in water, and that the undispersed resin was present. The solid concentration of the resulting resin particle dispersion was measured. As a result, the solid content was 5.4%.

By the above-mentioned method, non-crystalline polyester resin particle dispersion L9 having a median resin particle size of 1,020 nm and a pH of 6.1 was obtained.

Further, for the resulting resin particle dispersion, the S content and the N content were measured by ICP. The results thereof are as described in Table 2, and the N/S ratio was 1.02.

Furthermore, for air-dried matter of the resulting resin particle dispersion, the residual metal concentration was measured by the fluorescent X-ray analysis. As a result, it was equal to or less than the detection limit.

<Preparation of Resin P10' and Resin Particle Dispersion L10>

| (Preparation of Resin P10') | |
|---|---|
| Bisphenol A Ethylene Oxide 2 mol Adduct | 25.143 parts |
| Bisphenoxyethanolfluorene | 8.536 parts |
| 1,4-Phenylenediacetic Acid | 16.80 parts |
| Dibutyltin Oxide | 0.105 part |

The above-mentioned materials were mixed and placed in a reactor equipped with a stirrer, and polycondensation was conducted in an open system for 19 hours so as to give a resin temperature of 190° C. As a result, dark brownish colored translucent non-crystalline polyester resin P10 was obtained. A small amount of a resin sample was collected, and the following physical characteristics were measured.

Weight Average Molecular Weight by GPC: 19,950

Glass Transition Temperature: 64° C.

Thirty parts of resin P10 obtained as described above was weighed, and placed in a reactor similarly provided with a stirrer. Then, 0.35 part of monoethanolamine was added, and stirring was performed at 100° C. for 10 minutes to obtain resin P10'.

(Preparation of Resin Particle Dispersion L10)

To resin P10' obtained as described above, 45 parts of ion exchanged water heated at 90° C. was added, and stirring was continued for 2 hours to obtain an aqueous polyester dispersion.

Then, the presence or absence of the undispersed resin in the resin particle dispersion stirred in a homogenizer (manufactured by IKA Works, Inc., Ultra-Turrax T50) for 3 minutes was confirmed. As a result, the resin was entirely dispersed in water, and no undispersed resin was observed at all. Thus, the resin particle dispersion having a solid content of 40% was obtained.

By the above-mentioned method, non-crystalline polyester resin particle dispersion L10 having a median resin particle size of 190 nm and a pH of 8.20 was obtained. The particle size of the resulting resin particle dispersion was measured with a laser diffraction type particle size distribution measuring device (manufactured by Horiba Ltd., LA-920).

Further, for air-dried matter of the resulting resin particle dispersion, the residual metal concentration was measured by the fluorescent X-ray analysis. As a result, it was 600 ppm.

<Preparation of Resin Particle Dispersion L11>

Thirty parts of resin P5 obtained as described above was weighed, and placed in a reactor similarly provided with a stirrer. Further, 0.5 part of soft type sodium dodecylbenzenesulfonate was added, and the resulting mixture was dissolved in 300 parts of ethyl acetate to prepare a homogeneous oil phase. To this oil phase, 1 N—NaOH and water were gradually added to perform phase inversion emulsification. The phase inversion emulsification was performed by adding water with heating at 60° C. and with sufficiently mixing and dispersing by a homogenizer (manufactured by IKA Works, Inc., Ultra-Turrax T50) in the above-mentioned reactor.

Stirring with the homogenizer was continued to obtain a polyester resin particle dispersion. This dispersion was placed in a rotary evaporator, and desolvation was continued for 10 hours while decreasing the pressure.

By the above-mentioned method, non-crystalline polyester resin particle dispersion L11 having a median resin particle size of 170 nm, a pH of 7.9 and a solid concentration of 40% was obtained.

Further, for the resulting resin particle dispersion, the S content and the N content were measured by ICP. The results thereof are as described in Table 2. The N content was equal to or less than the detection limit, so that the N/S ratio was taken as 0.

Furthermore, for air-dried matter of the resulting resin particle dispersion, the residual metal concentration was measured by the fluorescent X-ray analysis. As a result, it was equal to or less than the detection limit.

TABLE 1

| Resin | | P1 | P2 | P3 | P4 | P5 |
|---|---|---|---|---|---|---|
| Alcohol 1 | | BPA-2EO = 80% | BPA-2PO = 80% | BPZ-2EO = 100% | BPA-2PO = 80% | BPA-2EO = 80% |
| Alcohol 2 | | BPEF = 20% | BPEF = 20% | — | BPEF = 20% | BPEF = 20% |
| Acid | | CHDA = 100% | PDAA = 100% | PDAA = 100% | PDAA = 100% | CHDA = 100% |
| Acid Cat./Conc. | | DBSA/ 0.2 mol % | DBSA/ 0.2 mol % | DBSA/ 0.2 mol % | DBSA/ 5 mol % | DBSA/ 0.1 mol % |
| Mw | | 18,150 | 16,540 | 13,950 | 18,890 | 17,770 |
| Tg (° C.) | | 65 | 68 | 63 | 65 | 65 |
| Resin | | P1' | P2' | P3' | P4' | P5' |
| Base/Conc. | | Triethanolamine/ 2 mol % | Diethanolamine/ 40 mol % | Monoethanolamine/ 0.22 mol % | Tributanolamine/ 200 mol % | Triethanolamine/ 0.24 mol % |
| Coloring Change of Rein with Time | | Good | Good | Good | Good | Good |
| Resin Particle Dispersion | | L1 | L2 | L3 | L4 | L5 |
| Median Size (nm) | | 190 | 190 | 220 | 170 | 200 |
| pH | | 8.1 | 9.5 | 6.2 | 9.45 | 6.4 |
| Solid Conc. (%) | | 40 | 40 | 40 | 40 | 40 |
| ICP | N (at %) | 0.053 | 1.89 | 0.0061 | 2.65 | 0.0056 |
| | S (at %) | 0.0056 | 0.0049 | 0.0055 | 0.04 | 0.0028 |
| | N/S Ratio | 9.46 | 385.71 | 1.10 | 66.25 | 2.00 |
| Fluorescent X-ray | Residual Metal Conc. (ppm) | Equal to or less than the detection limit | Equal to or less than the detection limit | Equal to or less than the detection limit | Equal to or less than the detection limit | Equal to or less than the detection limit |

TABLE 2

| Resin | | P6 | P7 | P8 | P9 | P10 | P11 |
|---|---|---|---|---|---|---|---|
| Alcohol 1 | | BPA-2EO = 80% | BPA-2PO = 80% | BPA-2PO = 80% | BPA-2EO = 80% | BPA-2EO = 80% | BPA-2EO = 80% |
| Alcohol 2 | | BPEF = 20% | BPEF = 20% | BPEF = 20% | BPEF = 20% | BPEF = 20% | BPEF = 20% |
| Acid | | CHDA = 100% | PDAA = 100% | PDAA = 100% | CHDA = 100% | PDAA = 100% | CHDA = 100% |
| Acid Cat./Conc. | | DBSA/ 0.2 mol % | DBSA/ 0.15 mol % | DBSA/ 50 mol % | DBSA/ 0.1 mol % | $Bu_2SnO$/ 0.2 mol % | DBSA/ 0.1 mol % |
| Mw | | 18,150 | 17,890 | 24,654 | 17,770 | 19,950 | 17,770 |
| Tg (° C.) | | 65 | 63 | 66 | 65 | 64 | 65 |
| Resin | | P6' | P7' | P8' | P9' | P10' | P11' |
| Base/Conc. | | Triethanolamine/ 0.18 mol % | Diethanolamine/ 100 mol % | Monoethanolamine/ 500 mol % | Triethanolamine/ 0.1 mol % | Triethanolamine/ 2 mol % | Phase inversion emulsification (no amine was used) |
| Coloring Change of Rein with Time | | Good | Poor | Good | Poor | Poor | Good |
| Resin Particle Dispersion | | L6 | L7 | L8 | L9 | L10 | L11 |
| Median Size (nm) | | 840 | 3,550 | 6,600 | 1,020 | 190 | 170 |
| pH | | 5.89 | 9.9 | 9.9 | 6.1 | 8.2 | 7.9 |
| Solid Conc. (%) | | 11 | 6.8 | 3.8 | 5.4 | 40 | 40 |
| ICP | N (at %) | 0.0051 | 2 | 4.02 | 0.0029 | 0.054 | 0 |
| | S (at %) | 0.057 | 0.0041 | 0.4 | 0.0028 | — | 0.0028 |
| | N/S Ratio | 0.89 | 487.80 | 10.05 | 1.02 | — | 0 |
| Fluo-rescent X-ray | Residual Metal Conc. (ppm) | Equal to or less than the detection limit | Equal to or less than the detection limit | Equal to or less than the detection limit | Equal to or less than the detection limit | 600 | Equal to or less than the detection limit |

Abbreviations in Table 1 and Table 2 are as follows:

BPA-2EO: Bisphenol A ethylene oxide 2 mol adduct

BPA-2PO: Bisphenol A propylene oxide 2 mol adduct

BPZ-2EO: Bisphenol Z ethylene oxide 2 mol adduct

BPEF: Bisphenoxyethanolfluorene

CDHA: 1,4-Cyclohexanedicarboxylic acid

PDAA: 1,4-Phenylenediacetic acid

DBSA: Dodecylbenzenesulfonic acid

In preparing toners using resin particle dispersions L1 to L11 prepared as described above a raw material, the following release agent particle dispersion W1 and colorant particle dispersion C1 were prepared.

<Preparation of Release Agent Particle Dispersion W1>

| | |
|---|---|
| Polyethylene Wax (manufactured by Toyo Petrolite K.K., Polywax 725, melting temperature: 103° C.) | 30 parts |
| Cationic Surfactant (manufactured by Kao Corp., Sanizol B50) | 3 parts |
| Ion Exchanged Water | 67 parts |

The above-mentioned components were thoroughly dispersed in dispersed in a homogenizer (manufactured by IKA Works, Inc., Ultra-Turrax T50) with heating at 95° C., and then, dispersed in a pressure-jet type homogenizer (manufactured by Gaulin, Inc., Gaulin homogenizer) to prepare release agent particle dispersion (W1). The number average particle size $D_{50n}$ of the release agent particles in the resulting dispersion was 460 nm. Thereafter, ion exchanged water was added to adjust the solid concentration of the dispersion to 30%.

<Preparation of Cyan Colorant Particle Dispersion C1>

| | |
|---|---|
| Cyan Pigment (manufactured by Dainichiseika Color & Chemicals Mfg. Co., Ltd., C.I. Pigment Blue 15:3) | 20 parts |
| Anionic surfactant (manufactured by Daiichi Kogyo Seiyaku Co., Ltd., Neogen R,) | 2 parts |
| Ion Exchanged Water | 78 parts |

The above-mentioned components were mixed and melted, and dispersed in a homogenizer (manufactured by IKA Works, Inc., Ultra-Turrax) for 5 minutes and in an ultrasonic bath for 10 minutes to obtain cyan colorant particle dispersion C1. The number average particle size $D_{50n}$ of the pigment in the dispersion was 121 nm. Thereafter, ion exchanged water was added to adjust the solid concentration of the dispersion to 15%.

<Preparation of Yellow Colorant Particle Dispersion Y1>

| | |
|---|---|
| Yellow Pigment (manufactured by Clariant (Japan) K.K., C.I. Pigment Yellow 74) | 20 parts |
| Anionic Surfactant (manufactured by Daiichi Kogyo Seiyaku Co., Ltd., Neogen R) | 2 parts |
| Ion Exchanged Water | 78 parts |

Using the above-mentioned components, colorant particle dispersion Y1 was obtained in the same manner as with cyan colorant particle dispersion C1. The number average particle size $D_{50n}$ of the pigment in the dispersion was 118 nm. Thereafter, ion exchanged water was added to adjust the solid concentration of the dispersion to 15%.

<Preparation of Magenta Colorant Particle Dispersion M1>

Magenta colorant particle dispersion M1 having a median size of 165 nm and a solid content of 21.5% was obtained in the same manner as in the preparation of cyan colorant particle dispersion C1 with the exception that a magenta pigment (manufactured by Dainichiseika Color & Chemicals Mfg. Co., Ltd, C.I. Pigment Red 122) was used in place of the cyan pigment.

TONER EXAMPLES

Preparation of Toner Particles

Toner Example 1

Preparation of Toner Using Resin Particle Dispersion L1

| | |
|---|---|
| Resin Particle Dispersion L1 | 160 parts |
| Release Agent Particle Dispersion W1 | 33 parts |
| Cyan Colorant Particle Dispersion C1 | 60 parts |
| 10 wt % Aqueous Polyaluminum Chloride Solution (manufactured by Asada Kagaku K.K., PAC 100W) | 15 parts |
| 1% Aqueous Nitric Acid Solution | 3 parts |

The above-mentioned components were dispersed in a round-shaped stainless steel flask by using a homogenizer (Ultra-Turrax T50, manufactured by IKA Works, Inc.) at 5,000 rpm for 3 minutes, and then, a lid equipped with a stirrer having magnetic seal, a thermometer and a pH meter was put on the above-mentioned flask. Thereafter, a mantle heater for heating was set, and the rotation number was appropriately controlled to the minimum necessary for stirring the entire dispersion in the flask. Then, heating was performed up to 62° C. at a rate of 1° C./min with stirring. The temperature was kept at 62° C. for 30 minutes, and the particle size of the coagulated particles was confirmed with a Coulter counter (manufactured by Nikkaki, TAII). After the termination of the temperature rise, 50 parts of resin particle dispersion L1 was immediately added, and the mixture was kept for 30 minutes. Thereafter, an aqueous sodium hydroxide solution was added until the pH of the inside of the system became 6.5, followed by heating up to 97° C. a rate of 1° C./min. After the temperature rise, an aqueous nitric acid solution was added to adjust the pH of the system to 5.0, and the mixture is kept for 10 hours to heat fuse the coagulated particles.

Thereafter, the temperature of the inside of the system was lowered to 50° C., and an aqueous sodium hydroxide solution was added to adjust the pH to 12.0. The mixture was kept for 10 minutes, and thereafter, taken out from the flask. Then, the mixture was sufficiently filtrated and flow-washed using ion exchanged water, and further dispersed in ion exchanged water to a solid content of 10% by weight. After adjusting the pH to 3.0 by adding a nitric acid and stirring for 10 minutes, the mixture was sufficiently filtrated and flow-washed again by using ion exchanged water. The resulting slurry was freeze-dried to obtain a cyan toner (Toner C1).

Silica ($SiO_2$) particles subjected to surface hydrophobing treatment with hexamethyldisilazane (hereinafter also referred to as "HMDS") and having an average primary particle size of 40 nm, and metatitanic acid compound particles having an average primary particle size of 20 nm, which was a reaction product of metatitanic acid and isobutyltrimethoxysilane, were added each in an amount of 1% by weight to the above-mentioned toner C1, followed by mixing in a HENSCHEL™ MIXER to prepare a cyan external addition toner.

Thus, the particle size of the toner particles was measured with a Coulter counter. As a result, the accumulated volume average particle size $D_{50}$ was 4.55 μm, and the volume average particle size distribution index GSDv was 1.20. Further, the shape factor SF1 of the toner particle determined from shape observation by Luzex was 134, and the particle was potato-shaped.

Toner Example 2

Preparation of Toner Using Resin Particle Dispersion L2

A cyan colored toner was obtained in the same manner as in Toner Example 1 with the exception that the resin was changed to P2, and the resin particle dispersion was changed to L2. The accumulated volume average particle size $D_{50}$, the volume average particle size distribution index GSDv and the shape factor were measured. External additives were externally added to this toner in the same manner as in Toner Example 1 to obtain a cyan external addition toner.

As a result, in Toner Example 2, D50 was 4.71 μm, and the volume average particle size distribution index GSDv was 1.20. The shape factor SF1 was 131, and the toner was potato-shaped.

Toner Examples 3 to 5

Cyan toners described below were obtained in the same manner as in Toner Example 1 with the exception that the resin particle dispersion was changed to L3 to L5, respectively. The accumulated volume average particle size $D_{50}$, the volume average particle size distribution index GSDv and the shape factor were measured. External additives were externally added to these toners in the same manner as in Toner Example 1 to obtain cyan external addition toners.

In Toner Example 3 using resin particle dispersion L3, a toner having a $D_{50}$ of 4.77, a GSDv of 1.20 and a shape factor SF1 of 124 was obtained.

In Toner Example 4 using resin particle dispersion L4, a toner having a $D_{50}$ of 4.57, a GSDv of 1.20 and a shape factor SF1 of 133 was obtained.

In Toner Example 5 using resin particle dispersion L5, a toner having a $D_{50}$ of 4.43, a GSDv of 1.20 and a shape factor SF1 of 130 was obtained.

Toner Comparative Examples 1 to 6

Preparation of Toners Using Resin Particle Dispersions L6 to L11

Cyan toners were obtained in the same manner as in Toner Example 1 with the exception that the resin particle dispersion was changed to L6 to L11, respectively. The accumulated volume average particle size $D_{50}$, the volume average particle size distribution index GSDv and the shape factor were measured. External additives were externally added to these toners in the same manner as in Toner Example 1 to obtain cyan external addition toners.

As a result, in Toner Comparative Example 1 using resin particle dispersion L6, a toner having a $D_{50}$ of 4.65, a GSDv of 1.25 and a shape factor SF1 of 127 was obtained.

In Toner Comparative Example 2 using resin particle dispersion L7, a toner having a $D_{50}$ of 4.85, a GSDv of 1.30 and a shape factor SF1 of 133 was obtained.

In Toner Comparative Example 3 using resin particle dispersion L8, a toner having a $D_{50}$ of 4.85, a GSDv of 1.30 and a shape factor SF1 of 135 was obtained.

In Toner Comparative Example 4 using resin particle dispersion L9, a toner having a $D_{50}$ of 5.11, a GSDv of 1.31 and a shape factor SF1 of 130 was obtained.

In Toner Comparative Example 5 using resin particle dispersion L10, a toner having a $D_{50}$ of 5.04, a GSDv of 1.31 and a shape factor SF1 of 135 was obtained.

In Toner Comparative Example 6 using resin particle dispersion L11, a toner having a $D_{50}$ of 5.07, a GSDv of 1.30 and a shape factor SF1 of 135 was obtained.

<Preparation of Carrier>

A methanol solution containing 0.1 part by weight of γ-aminopropyltriethoxysilane was added to 100 parts by weight of Cu—Zn ferrite particles having a volume average particle size of 35 μm, and after coating using a kneader, methanol was removed by distillation, followed by further heating at 120° C. for 2 hours to completely harden the above-mentioned silane compound. A perfluorooctylethyl methacrylate-methyl methacrylate copolymer (copolymerization ratio: 40:60) dissolved in toluene was added to the particles, and a resin-coated type carrier was produced by using a vacuum kneader so that the coating amount of the perfluorooctylethyl methacrylate-methyl methacrylate copolymer became 0.5% by weight.

<Preparation of Developer>

Eight parts by weight of each toner prepared as described above was added to 100 parts by weight of the resulting resin-coated type carrier, and mixed in a V blender to produce an electrostatic image developer. These developers were used as a developer in the following evaluations.

Using the respective developers prepared as described above, the following toner evaluation and image quality evaluation were performed.

<Evaluation of Toner and Image Quality>

The evaluation of image quality with the developers obtained by the methods described above was made by using a modified Docu Centre Color 500CP apparatus manufactured by Fuji Xerox Co., Ltd. at a fixing temperature of 140° C. at a process speed of 240 mm/sec. For the evaluation by storage under circumstances of high temperature and high humidity, the evaluation was made after the above-mentioned modified apparatus had been stored under circumstances of 35° C. and 65% RH.

(1) ΔL* (Difference in AC 5% Image Density) Image Quality Evaluation of Cyan Low Area Coverage Image before and after Storage under Circumstances of High Temperature and High Humidity For each of the toners prepared in Examples and Comparative Examples, a cyan image was printed on one sheet of paper at an area coverage of 5% (A4 size) using the above-mentioned modified Docu Centre Color 500CP apparatus at room temperature, and the value of L* was measured Then, after stored under circumstances of high temperature and high humidity for 60 days, the value of L* of a sample printed at an area coverage of 5% (A4 size) in the same manner as described above was measured. Criteria of evaluation are shown below.

Based on a result of ΔL (before storage)=L* (after storage for 60 days), three-stage evaluation was made according to the following criteria:

Good: $\Delta L^* < 0.6$

Fair: $0.6 \leqq \Delta L^* \leqq 0.7$

Poor: $\Delta L^* > 0.7$

The value of the color value L of the resin was determined by preparing a pellet by the following method, and then, measuring L* with X-Rite 404 manufactured by X-Rite.

—Method for Preparing Pellet—

The resin obtained above was pulverized in a sample mill to an average particle size of about 1 mm or less, and 6.0 g of the pulverized product was collected. A load of about 20 t was applied thereto in a compression molding machine for 1 minute, thereby obtaining a disk-shaped pellet having a diameter of 5 cm and a thickness of 3 mm.

There is no particular limitation on the compression molding machine used herein, as long as a load of 1 ton or more can be applied.

The above-mentioned evaluation was made for the respective toners obtained above. As a result, for all the toners of Examples 1 to 4 and Comparative Example 2, the change in color value L* was smaller than 0.6, and no difference in color value of the image was also visually observed. However, for the toners of Comparative Examples 1, 4 and 5, the change in color value L* was 0.6 or more, and the difference in color value between before and after storage was also visually observed.

(2) Gloss Unevenness Evaluation of Process Black (ΔGloss)

Yellow toners were prepared in the same manner as with the cyan toners prepared in Examples 1 to 5 and Comparative Examples 1 to 6 using resin particle dispersions L1 to L11 with the exception that the colorant particle dispersion was changed from C1 to Y1. Similarly, magenta toners were prepared by changing the colorant particle dispersion C1 to M1.

A 5×5 cm unfixed solid image of a process black color formed by 3 colors of the resulting cyan toner, yellow toner and magenta toner was formed, and fixed by the above-mentioned fixing method. Then, the gloss measurement was made for 5 points including a center portion of a solid image forming area and the periphery thereof. A judgment was made as follows by the difference between the gloss maximum value and the gloss minimum value of the 5 measurements.

Good: ΔGloss=(Gloss maximum value)-(Gloss minimum value)≦4

Fair: 4≦ΔGloss≦5

Poor: 5≦ΔGloss

The above-mentioned evaluation was made for the respective toners obtained. As a result, no gloss unevenness was visually confirmed for the fixed images of Examples 1 to 5 and Comparative Examples 1, 4 and 5, and ΔGloss was 4 or less. On the other hand, for the toners of Comparative Examples 2 and 3, gloss unevenness was visually confirmed, and ΔGloss was 5 or more.

Evaluation of Fogging on Non-image Area under High Humidity

For a non-mage area between thin lines of image quality in which a thin-line image was fixed by using the above-mentioned modified apparatus, measurement was made with a reflection densitometer (X-Rite 404, manufactured by X-Rite USA). When an increase in reflection density at background fogging was larger than 0.01, it was evaluated as "poor". When an increase in density was 0.01, it was evaluated as "fair", and less than 0.01 was evaluated as "good".

The above-mentioned evaluation was made for the respective toners obtained. As a result, when the toners of Examples 1 to 5 and Comparative Examples 2 and 3 were used, no fogging was observed at all, and the measurement of the density of the non-image areas with X-Rite 404 also showed a value of less than 0.01.

On the other hand, when the toners of Comparative Examples 1 and 4, a density of 0.01 was confirmed in the measurement of the density of the non-image areas with X-Rite 404, and in Comparative Examples 5 and 6, it was visually observed that fogging slightly occurred.

TABLE 3

| | | | Toner Example | | | | |
|---|---|---|---|---|---|---|---|
| | | | 1 | 2 | 3 | 4 | 5 |
| Element Concentration in Toner | | N (at %) | 0.0053 | 0.0378 | 0.00304 | 2.45 | 0.0021 |
| | | S (at %) | 0.00456 | 0.00392 | 0.00443 | 0.54 | 0.00382 |
| | | N/S Ratio | 1.18 | 9.64 | 0.69 | 4.54 | 0.55 |
| Image Qualify Evaluation | ΔL* Value Evaluation | L* before Storage at High Humidity | 91.55 | 91.44 | 91.39 | 91.41 | 91.51 |
| | | L* after Storage at High Humidity | 91.44 | 91.38 | 91.22 | 91.28 | 91.39 |
| | | ΔL* | 0.11 | 0.06 | 0.17 | 0.13 | 0.12 |
| | | Judgment | Good | Good | Good | Good | Good |
| | Process Black Gloss Unevenness | Gloss Maximum Value | 85.6 | 84.3 | 87.5 | 85.5 | 84.3 |
| | | Gloss Minimum Value | 84.2 | 83.5 | 86.0 | 83.5 | 82.2 |
| | | ΔGloss | 1.4 | 0.8 | 1.5 | 2.0 | 2.1 |
| | | Judgment | Good | Good | Good | Good | Good |
| | Non-Image Area Fogging under High Humidity | | Good | Good | Good | Good | Good |

TABLE 4

| | | | Toner Comparative Example | | | | | |
|---|---|---|---|---|---|---|---|---|
| | | | 1 | 2 | 3 | 4 | 5 | 6 |
| Element Concentration in Toner | | N (at %) | 0.00051 | 0.04 | 2.75 | 0.00180 | 0.0056 | 0 |
| | | S (at %) | 0.00456 | 0.00328 | 0.40 | 0.00224 | — | 0 |
| | | N/S Ratio | 0.11 | 12.20 | 6.88 | 0.80 | — | 0 |
| Image Qualify Evaluation | ΔL* Value Evaluation | L* before Storage at High Humidity | 91.45 | 91.55 | 91.55 | 91.37 | 91.55 | 91.55 |
| | | L* after Storage at High Humidity | 89.42 | 91.44 | 91.44 | 88.25 | 91.44 | 91.44 |
| | | ΔL* | 2.03 | 0.11 | 0.11 | 3.12 | 0.11 | 0.11 |
| | | Judgment | Poor | Good | Good | Poor | Good | Good |
| | Process Black Gloss Unevenness | Gloss Maximum Value | 85.2 | 84.5 | 84.3 | 85.9 | 85.2 | 84.4 |
| | | Gloss Minimum Value | 82.9 | 79.3 | 78.8 | 83.2 | 82.3 | 72.5 |
| | | ΔGloss | 2.3 | 5.2 | 5.5 | 2.7 | 2.9 | 11.9 |
| | | Judgment | Good | Poor | Poor | Good | Good | Good |
| | Non-Image Area Fogging under High Humidity | | Fair | Good | Good | Fair | Poor | Poor |

What is claimed is:

1. An electrostatic image developing toner comprising a binder resin, wherein the binder resin consists essentially of polyester, the electrostatic image developing toner has a sulfur element concentration S at % and a nitrogen element concentration N at % which satisfy $0.5 \leqq N/S \leqq 10$, the nitrogen element concentration N being from 0.002 at % to 2.5 at %, and the polyester is a non-crystalline polyester having a glass transition temperature of 50° C. to 80° C.

2. The electrostatic image developing toner according to claim 1, wherein the sulfur element concentration S at % and the nitrogen element concentration N at % satisfy $0.8 \leqq N/S \leqq 9.0$.

3. The electrostatic image developing toner according to claim 1, wherein the sulfur element concentration S at % and the nitrogen element concentration N at % satisfy $1 \leqq N/S \leqq 8.5$.

4. The electrostatic image developing toner according to claim 1, wherein the polyester has a weight average molecular weight of 1,500 to 55,000.

5. A method for producing an electrostatic image developing toner, comprising:

polycondensating a polycondensable monomer with a sulfur acid as a polycondesation catalyst to produce a polyester;

emulsion-dispersing the polyester in an aqueous medium with a nitrogen atom-containing compound to produce a resin particle dispersion liquid;

coagulating resin particles in a dispersion liquid including the resin particle dispersion liquid to produce coagulated particles; and heating and fusing coagulated particles, the electrostatic image developing toner being an electrostatic image developing toner according to claim 1.

6. The method for producing an electrostatic image developing toner according to claim 5, the polycondensable monomer includes at least one selected from the group consisting of a polyvalent carboxylic acid, a polyol, and a hydroxycarboxylic acid.

7. The method for producing an electrostatic image developing toner according to claim 5, wherein the polycondensating is performed at a temperature of 150° C. or lower.

8. The method for producing an electrostatic image developing toner according to claim 5, wherein the sulfur acid includes at least one of an inorganic sulfur acid and an organic sulfur acid.

9. The method for producing an electrostatic image developing toner according to claim 5, wherein the polycondesation catalyst includes a basic substance.

10. The method for producing an electrostatic image developing toner according to claim 5, wherein the nitrogen atom-containing compound is an organic amine material.

11. The method for producing an electrostatic image developing toner according to claim 10, wherein the organic amine material is represented by formula (I):

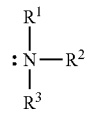

(I)

wherein $R^1$, $R^2$ and $R^3$ each independently represents a hydrogen atom, a hydrocarbon group, $—(CH_2)_n—OH$ or $—(CH_2)_m—O—(CH_2)_n—OH$, m is an integer of 2 to 6, and n is an integer of 2 to 6, provided at least one of $R^1$, $R^2$ and $R^3$ contains an OH group.

12. An image forming method comprising:

forming an electrostatic latent image on a surface of a latent image carrier;

developing the electrostatic latent image with a developer including a toner to form a toner image on the latent image carrier;

transferring the toner image to a transfer material; and fixing the toner image transferred on a surface of the transfer material, the develop including an electrostatic image developing toner according to claim 1.

13. An image forming apparatus comprising:

a latent image carrier;

a charging means for charging the latent image carrier;

an exposing means for exposing the charged latent image carrier with light to form a electrostatic latent image on the latent image carrier;

a developing means that contains a developer for developing the electrostatic latent image with the developer to form a toner image; and a transfer means for transferring the toner image from the latent image carrier to a recording material, the developer including an electrostatic image developing toner according to claim 1.

14. An electrostatic image developer comprising:

an electrostatic charge developing toner comprising a binder resin, wherein the binder resin consists essentially of polyester, and the electrostatic image developing toner has a sulfur element concentration S at % and a nitrogen element concentration N at % which satisfy $0.5 \leqq N/S \leqq 10$, the nitrogen element concentration N being from 0.002 at % to 2.5 at %; and a carrier.

* * * * *